US011168495B1

(12) United States Patent
Liang et al.

(10) Patent No.: US 11,168,495 B1
(45) Date of Patent: Nov. 9, 2021

(54) AUTOMATICALLY RESETTING WINDOW VENT STOP WITH DUAL SAFETY FEATURES

(71) Applicant: Vision Industries Group, Inc., So. Plainfield, NJ (US)

(72) Inventors: Luke Liang, So. Plainfield, NJ (US); David Chen, Guangzhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 690 days.

(21) Appl. No.: 16/051,647

(22) Filed: Aug. 1, 2018

(51) Int. Cl.

| | |
|---|---|
| ***E05B 63/20*** | (2006.01) |
| ***E05C 3/12*** | (2006.01) |
| ***E05C 19/06*** | (2006.01) |
| ***E05C 19/02*** | (2006.01) |
| ***E05B 65/08*** | (2006.01) |

(52) U.S. Cl.
CPC ..... *E05B 63/20* (2013.01); *E05B 65/0852* (2013.01); *E05C 3/12* (2013.01); *E05C 19/022* (2013.01); *E05C 19/06* (2013.01)

(58) Field of Classification Search
CPC .. E05B 63/20; E05B 65/0823; E05B 65/0852; E05B 65/0876; E05C 3/12; E05C 17/48; E05C 17/60; E05C 19/022; E05C 19/06; Y10T 292/1039; Y10T 292/104; Y10T 292/1041; Y10T 292/0802; Y10S 292/20; Y10S 292/47; E06B 3/0563
See application file for complete search history.

(56) References Cited

U.S. PATENT DOCUMENTS

| | | | |
|---|---|---|---|
| 417,868 | A | 12/1839 | Janes |
| 16,228 | A | 12/1856 | Copeland |
| 30,408 | A | 10/1860 | Judd |
| 36,524 | A | 9/1862 | Minor |
| 51,222 | A | 11/1865 | Ridell |

(Continued)

FOREIGN PATENT DOCUMENTS

| | | |
|---|---|---|
| GB | 2 286 627 | 8/1995 |
| GB | 2 461 078 | 12/2009 |

(Continued)

*Primary Examiner* — Kristina R Fulton
*Assistant Examiner* — Yahya I Sidky
(74) *Attorney, Agent, or Firm* — Thomas A. O'Rourke; Bodner & O'Rourke, LLP

(57) ABSTRACT

A vent stop includes: a housing; a tumbler; a biasing member having a first portion secured to the tumbler and a second portion in movable contact with a housing track, to selectively bias the tumbler. Movement of the second portion along the track is coordinated with sequential pivoting of the tumbler between extended, retracted, partially extended, and intermediate positions. In the extended position, a tumbler bearing surface limits opening of the sash member. When toggled from the extended position to the retracted position and subsequently released, outward bias of the tumbler is limited to the partially extended position by contact of the second portion with a track recess. Subsequent contact of the sash member with the deflection surface causes pivoting from the partially extended to the intermediate position, permitting unrestricted sash member opening, release of the second portion from the contact point, and biasing back toward the extended position.

11 Claims, 16 Drawing Sheets

(56) References Cited

U.S. PATENT DOCUMENTS 108,778 A 11/1870 Gorman
115,781 A 6/1871 Steele
126,872 A 5/1872 Buckman
148,857 A 3/1874 Smith
163,008 A 5/1875 Gillespie
166,842 A 8/1875 Berryman
178,360 A 6/1876 Cooper
190,074 A 4/1877 Penfield
192,614 A 7/1877 Andrews
192,919 A 7/1877 Hoyt
201,146 A 3/1878 Adler
226,033 A 3/1880 Burns
230,476 A 7/1880 Green
234,387 A 11/1880 Burgess
284,993 A 9/1883 Abele
314,350 A 3/1885 Smith
316,285 A 4/1885 McKeen
331,005 A 11/1885 Sahr
336,302 A 2/1886 Dudgeon
346,788 A 8/1886 Teufel
350,678 A 10/1886 Hussey
353,287 A 11/1886 Chumard
368,595 A 8/1887 King
369,885 A 9/1887 Shaw
375,656 A 12/1887 Shaw
376,252 A 1/1888 McIntyre
379,910 A 3/1888 Rosentreter
410,728 A 9/1889 Brown
423,761 A 3/1890 Hasenpflug
426,303 A 4/1890 McGovern
447,068 A 2/1891 Dixon
452,723 A 5/1891 Schmalhausen
471,363 A 3/1892 Sloan
480,148 A 8/1892 Theby
493,159 A 3/1893 Gibson
569,941 A 12/1893 Perry
512,593 A 1/1894 Webster
520,754 A 5/1894 Burmeister
526,118 A 9/1894 Sharp
528,656 A 11/1894 Burmeister
530,078 A 12/1894 Ammerman
534,185 A 2/1895 Winchester
537,258 A 4/1895 Wilcox
539,030 A 5/1895 Bitner
551,181 A 12/1895 Dillon
551,242 A 12/1895 Wallace
554,448 A 2/1896 Keil
564,426 A 7/1896 Hubbard
572,591 A 12/1896 Woodard
587,424 A 8/1897 Bonine
590,225 A 9/1897 Hill
653,458 A 7/1900 Paquette
666,596 A 1/1901 Breen
683,928 A 10/1901 Geraghty
688,491 A 12/1901 Sigler
695,736 A 3/1902 Kendrick
698,742 A 4/1902 Schamweber
699,696 A 5/1902 Mellen
708,406 A 9/1902 Robison
714,343 A 11/1902 Wellman
718,007 A 1/1903 Linn
719,981 A 2/1903 Adams
722,162 A 3/1903 St. Louis
724,466 A 4/1903 Hannan
743,716 A 11/1903 Hadka
744,755 A 11/1903 Hasenpflug
745,888 A 12/1903 McElwee
749,469 A 1/1904 Assorati
756,453 A 4/1904 Arens
756,559 A 4/1904 Arens
757,249 A 4/1904 Barnard
759,642 A 5/1904 Sparks
764,493 A 7/1904 Noseworthy
769,386 A 9/1904 Johnson
769,767 A 9/1904 Phelps
774,536 A 11/1904 Saunders
775,602 A 11/1904 Hearnshaw
800,043 A 9/1905 Witte
804,994 A 11/1905 Andrews
815,537 A 3/1906 Kissinger
833,900 A 10/1906 Sigler
837,811 A 12/1906 Ebbeson
840,427 A 1/1907 Brister
865,090 A 9/1907 Eddy
866,073 A 9/1907 Saunders
878,206 A 2/1908 Johnson
881,658 A 3/1908 Bowman
886,108 A 4/1908 Allen
887,690 A 5/1908 Pearce
922,894 A 5/1908 Heid
897,719 A 9/1908 Daubaignan
900,079 A 10/1908 Bittorf
910,850 A 1/1909 Petrie
913,730 A 3/1909 Kapus
926,899 A 7/1909 Roy
928,408 A 7/1909 Taube
948,628 A 2/1910 Jefferis
959,150 A 5/1910 Morris
963,983 A 7/1910 Bernhard
966,063 A 8/1910 Toothaker
976,777 A 11/1910 Brown
980,131 A 12/1910 Shean
998,642 A 7/1911 Shean
1,003,386 A 9/1911 Welker
1,006,211 A 10/1911 Hermon
1,020,454 A 3/1912 Seidenbecker
1,041,803 A 10/1912 Kilburn
1,051,918 A 2/1913 Rowley
1,059,999 A 4/1913 James
1,069,079 A 7/1913 Voight
1,077,487 A 11/1913 Milter
1,089,172 A 12/1913 Rusk
1,100,820 A 6/1914 Edwards
1,121,228 A 12/1914 Burkhart
1,122,026 A 12/1914 O'Rourke
1,127,835 A 2/1915 Westlund
1,133,217 A 3/1915 Barton
1,141,437 A 6/1915 Unterlender
1,148,712 A 8/1915 Overland
1,163,086 A 12/1915 Harper
1,173,129 A 2/1916 Taliaferro
1,177,637 A 4/1916 Lane
1,177,838 A 4/1916 Wilkinson
1,207,989 A 12/1916 O'Rourke
1,232,683 A 7/1917 Holllis
1,243,115 A 10/1917 Shur
1,244,725 A 10/1917 Gadke
1,253,810 A 1/1918 Gianninoto
1,261,274 A 4/1918 Newsam
1,269,467 A 6/1918 Winters
1,270,740 A 6/1918 Keyes
1,272,900 A 7/1918 Berman
1,279,353 A 9/1918 Kelley
1,311,052 A 7/1919 Danforth
1,322,677 A 11/1919 Ditlelsen
1,338,250 A 4/1920 Parkes
1,338,416 A 4/1920 Bellinger
1,339,362 A 5/1920 L'Heureux
1,341,234 A 5/1920 Horton
1,350,698 A 8/1920 Boedtcher
1,387,302 A 8/1921 Page
1,388,272 A 8/1921 Lawrence
1,393,628 A 10/1921 Leichter
1,398,174 A 11/1921 Carlson
1,399,897 A 12/1921 Singer
1,412,154 A 4/1922 Wollesen
1,439,585 A 12/1922 Trost
1,461,467 A 7/1923 Stuart
1,463,866 A 8/1923 Bourbeau
1,470,858 A 10/1923 Maxwell
1,485,382 A 3/1924 Foley
1,490,874 A 4/1924 Webb
1,516,995 A 11/1924 Trigueiro
1,550,532 A 8/1925 French

(56) References Cited

U.S. PATENT DOCUMENTS 1,552,690 A 9/1925 Frantz
1,601,051 A 9/1926 Wilbert
1,605,717 A 11/1926 Gregg
1,619,031 A 3/1927 Ostrosky
1,622,742 A 3/1927 Shipmnan
1,656,818 A 1/1928 Dillon
1,692,579 A 11/1928 Schrader
1,704,946 A 3/1929 Lindgren
1,712,792 A 5/1929 Hansen
1,715,957 A 6/1929 Stein
1,724,637 A 8/1929 Bergstrom
1,750,715 A 3/1930 Jeffers
1,794,171 A 2/1931 Grutel
1,812,288 A 6/1931 Drapeau
1,819,824 A 8/1931 McAllister
1,864,253 A 6/1932 McIntyre
1,869,274 A 7/1932 Phillips
1,877,177 A 9/1932 Hinderer
1,891,940 A 12/1932 McAllister
1,900,936 A 3/1933 Huttger
1,901,974 A 3/1933 Macy
1,918,114 A 7/1933 Lorenzen
1,922,062 A 8/1933 Sullivan
1,940,084 A 12/1933 Grasso
1,960,034 A 5/1934 Stewart
1,964,114 A 6/1934 Gerlach
2,095,057 A 10/1937 Corrado
2,122,661 A 7/1938 Rightmyer
2,126,995 A 8/1938 Kingdon
2,136,408 A 11/1938 Bedell
2,158,260 A 5/1939 Stilman
2,202,561 A 6/1940 Lahiere
2,232,965 A 2/1941 Perl
2,272,145 A 2/1942 Anderson
2,326,084 A 8/1943 Westrope
2,369,584 A 2/1945 Lundholm
2,452,521 A 10/1948 Johnson
2,480,016 A 8/1949 Granberg
2,480,988 A 9/1949 Walton
2,500,349 A 3/1950 Menns
2,503,370 A 4/1950 Zanona
2,523,559 A 9/1950 Couture
2,527,278 A 10/1950 Schemansky
2,537,736 A 1/1951 Carlson
2,560,274 A 7/1951 Cantelo
2,581,816 A 1/1952 Schlueter
2,590,624 A 3/1952 James
2,599,196 A 6/1952 Peremi
2,605,125 A 7/1952 Emerson
2,612,398 A 9/1952 Miller
2,613,526 A 10/1952 Holmsten
2,621,951 A 12/1952 Ostadal
2,645,515 A 7/1953 Thomas
2,648,967 A 8/1953 Holmsten
2,670,982 A 3/1954 Banham
2,692,789 A 10/1954 Rivard
2,735,707 A 2/1956 Sylvan
2,758,862 A 8/1956 Endter
2,766,492 A 10/1956 Day
2,789,851 A 4/1957 Lickteig
2,818,919 A 1/1958 Sylvan
2,846,258 A 8/1958 Granberg
2,855,772 A 10/1958 Hillgren
2,884,276 A 4/1959 Baptist
2,941,832 A 6/1960 Grossman
2,997,323 A 8/1961 Riser
3,027,188 A 3/1962 Eichstadt
3,122,387 A 2/1964 Wakelin
3,135,542 A 6/1964 Wilkenson
3,187,526 A 6/1965 Moler
3,267,613 A 8/1966 McQuiston
3,288,510 A 11/1966 Gough
3,352,586 A 11/1967 Hakanson
3,362,740 A 1/1968 Burns
3,422,575 A 1/1969 Armstrong
3,425,729 A 2/1969 Bisbing
3,438,153 A 4/1969 Lemme
3,469,877 A 9/1969 Hutchison
3,599,452 A 8/1971 Maruyama
3,600,019 A 8/1971 Toyota
3,642,315 A 2/1972 Alpern
3,645,573 A 2/1972 Strang
3,683,652 A 8/1972 Halopoff
3,706,467 A 12/1972 Martin
3,762,750 A 10/1973 Orr
3,811,718 A 5/1974 Bates
3,907,348 A 9/1975 Bates
3,919,808 A 11/1975 Simmons
3,927,906 A 12/1975 Mieras
3,930,678 A 1/1976 Alexander
4,054,308 A 10/1977 Prohaska
4,059,298 A 11/1977 Van Klompenburg
4,063,766 A 12/1977 Granberg
4,068,871 A 1/1978 Mercer
4,095,827 A 6/1978 Stavenau
4,095,829 A 6/1978 Van Klompenburg
4,102,546 A 7/1978 Costello
4,151,682 A 5/1979 Schmidt
4,165,894 A 8/1979 Wojciechowski
2,920,914 A 1/1980 Jenkins
4,223,930 A 9/1980 Costello
4,227,345 A 10/1980 Durham
4,235,465 A 11/1980 Costello
4,253,688 A 3/1981 Hosooka
4,261,602 A 4/1981 Anderson
4,274,666 A 6/1981 Peck
4,293,154 A 10/1981 Cassells
4,303,264 A 12/1981 Uehara
4,305,612 A 12/1981 Hunt
4,392,329 A 7/1983 Suzuki
4,429,910 A 2/1984 Anderson
4,470,277 A 9/1984 Uyeda
4,475,311 A 10/1984 Gibson
4,525,952 A 7/1985 Cunningham
4,580,366 A 4/1986 Hardy
4,587,759 A 5/1986 Gray
4,621,847 A 11/1986 Paulson
4,624,073 A 11/1986 Randall
4,639,021 A 1/1987 Hope
4,643,005 A 2/1987 Logas
4,655,489 A 4/1987 Bisbing
4,736,972 A 4/1988 Mosch
4,801,164 A 1/1989 Mosch
4,813,725 A 3/1989 Mosch
4,824,154 A 4/1989 Simpson
4,826,222 A 5/1989 Davis
4,827,685 A 5/1989 Schmidt
4,893,849 A 1/1990 Schlack
4,922,658 A 5/1990 Coddens
4,923,230 A 5/1990 Simpson
4,949,506 A 8/1990 Durham
4,961,286 A 10/1990 Bezubic
4,991,886 A 2/1991 Nolte
5,042,855 A 8/1991 Bennett
5,072,464 A 12/1991 Draheim
5,076,015 A 12/1991 Manzalini
5,087,087 A 2/1992 Vetter
5,087,088 A 2/1992 Milam
5,090,750 A 2/1992 Lindqvist
5,090,754 A 2/1992 Thompson
5,092,640 A 3/1992 Plummer
5,110,165 A 5/1992 Piltingsrud
5,127,685 A 7/1992 Dallaire
5,139,291 A 8/1992 Schultz
5,143,412 A 9/1992 Lindqvist
5,161,839 A 11/1992 Piltingsrud
5,165,737 A 11/1992 Riegelman
5,183,310 A 2/1993 Shaughnessy
5,217,264 A 6/1993 Fier
5,219,193 A 6/1993 Piltingsrud
5,244,238 A 9/1993 Lindqvist
5,248,174 A 9/1993 Matz
5,274,955 A 1/1994 Dallaire
5,341,752 A 8/1994 Hambleton

(56) References Cited

U.S. PATENT DOCUMENTS

| | | | |
|---|---|---|---|
| 5,398,447 | A | 3/1995 | Morse |
| 5,437,484 | A | 8/1995 | Yamada |
| 5,448,857 | A | 9/1995 | Stormo |
| 5,452,925 | A | 9/1995 | Huang |
| 5,454,609 | A | 10/1995 | Slocomb |
| 5,536,052 | A | 7/1996 | Maier |
| 5,553,903 | A | 9/1996 | Prate |
| 5,560,149 | A | 10/1996 | Lafevre |
| 5,575,116 | A | 11/1996 | Carlson |
| 5,582,445 | A | 12/1996 | Olsen |
| RE35,463 | E | 2/1997 | Vetter |
| 5,636,475 | A | 6/1997 | Nidelkoff |
| 5,688,000 | A | 11/1997 | Dolman |
| 5,715,631 | A | 2/1998 | Kailian |
| 5,741,032 | A | 4/1998 | Chaput |
| 5,778,602 | A | 7/1998 | Johnson |
| 5,791,700 | A | 8/1998 | Biro |
| 5,806,900 | A | 9/1998 | Bratcher |
| 5,829,196 | A | 11/1998 | Maier |
| 5,839,767 | A | 11/1998 | Piltingsrud |
| 5,901,499 | A | 5/1999 | Delaske |
| 5,901,501 | A | 5/1999 | Fountaine |
| 5,911,763 | A | 6/1999 | Quesada |
| 5,927,768 | A | 7/1999 | Dallmann |
| 5,970,656 | A | 10/1999 | Maier |
| 5,992,907 | A | 11/1999 | Sheldon |
| 6,000,735 | A | 12/1999 | Jourdenais |
| 6,086,121 | A | 7/2000 | Buckland |
| 6,116,665 | A | 9/2000 | Subiskey |
| 6,135,510 | A | 10/2000 | Digioosa |
| 6,139,071 | A | 10/2000 | Hopper |
| 6,142,541 | A | 11/2000 | Rotondi |
| 6,155,615 | A | 12/2000 | Schulz |
| 6,176,041 | B1 | 1/2001 | Roberts |
| 6,178,696 | B1 | 1/2001 | Liang |
| 6,183,024 | B1 | 2/2001 | Schultz |
| 6,209,931 | B1 | 4/2001 | Von Stoutenborough |
| 6,217,087 | B1 | 4/2001 | Fuller |
| 6,230,443 | B1 | 5/2001 | Schultz |
| 6,250,694 | B1 | 6/2001 | Weiland |
| 6,279,266 | B1 | 8/2001 | Searcy |
| 6,349,576 | B2 | 2/2002 | Subliskey |
| 6,364,375 | B1 | 4/2002 | Szapucki |
| 6,450,544 | B2 | 9/2002 | Rotondi |
| 6,546,671 | B2 | 4/2003 | Mitchell |
| 6,565,133 | B1 | 5/2003 | Timothy |
| 6,668,723 | B2 | 5/2003 | Murphy |
| 6,588,150 | B1 | 7/2003 | Wong |
| 6,592,155 | B1 | 7/2003 | Lemley |
| 6,607,221 | B1 | 8/2003 | Elliott |
| 6,631,931 | B2 | 10/2003 | Magnusson |
| 6,634,683 | B1 | 10/2003 | Brannan |
| 6,688,659 | B2 | 2/2004 | Kobrehel |
| 6,817,142 | B2 | 11/2004 | Marshik |
| 6,848,728 | B2 | 2/2005 | Rotondi |
| 6,871,885 | B2 | 3/2005 | Goldenberg |
| 6,871,886 | B2 | 3/2005 | Coleman |
| 6,877,784 | B2 | 4/2005 | Kelley |
| 6,925,758 | B2 | 8/2005 | Petit |
| 6,957,513 | B2 | 10/2005 | Pettit |
| 6,983,963 | B2 | 1/2006 | Eslick |
| 7,000,957 | B2 | 2/2006 | Lawrence |
| 7,013,603 | B2 | 3/2006 | Eenigenburg |
| 7,017,957 | B2 | 3/2006 | Murphy |
| 7,036,851 | B2 | 5/2006 | Romig |
| 7,063,361 | B1 | 6/2006 | Lawrence |
| 7,070,211 | B2 | 7/2006 | Polowinczak |
| 7,070,215 | B2 | 7/2006 | Kelley |
| 7,100,951 | B2 | 9/2006 | Jien |
| 7,147,255 | B2 | 12/2006 | Goldenberg |
| 7,159,908 | B2 | 1/2007 | Liang |
| 7,171,784 | B2 | 2/2007 | Eenigenburg |
| 7,296,831 | B2 | 11/2007 | Generowicz |
| 7,322,619 | B2 | 1/2008 | Nolte |
| 7,322,620 | B1 | 1/2008 | Lawrence |
| 7,407,199 | B2 | 8/2008 | Richarttson |
| 7,431,356 | B2 | 10/2008 | Liang |
| 7,441,811 | B2 | 10/2008 | Lawrence |
| 7,481,470 | B2 | 1/2009 | Eenigenburg |
| 7,510,221 | B2 | 3/2009 | Eenigenburg |
| 7,530,611 | B2 | 5/2009 | Liang |
| 7,559,588 | B2 | 7/2009 | Liang |
| 7,607,262 | B2 | 10/2009 | Pettit |
| 7,637,544 | B2 | 12/2009 | Liang |
| 7,665,775 | B1 | 2/2010 | Miller |
| 7,699,365 | B2 | 4/2010 | Liang |
| 7,922,223 | B2 | 4/2011 | Lawrence |
| 7,976,077 | B2 | 7/2011 | Flory |
| 8,205,919 | B2 | 6/2012 | Flory |
| 8,205,920 | B2 | 6/2012 | Flory |
| 8,220,846 | B2 | 7/2012 | Liang |
| 8,231,148 | B2 | 7/2012 | Van Der Kooij |
| 8,235,430 | B2 | 8/2012 | Liang |
| 8,272,164 | B2 | 9/2012 | Albrecht |
| 8,336,930 | B2 | 12/2012 | Liang |
| 8,360,484 | B2 | 1/2013 | Liang |
| 8,414,039 | B2 | 4/2013 | Liang |
| 8,511,724 | B2 | 8/2013 | Liang |
| 8,550,507 | B2 | 10/2013 | Barton |
| 8,567,830 | B2 | 10/2013 | Liang |
| 8,657,347 | B2 | 2/2014 | Liang |
| 8,726,572 | B2 | 5/2014 | Derham |
| 8,789,857 | B2 | 7/2014 | Liang |
| 8,789,862 | B2 | 7/2014 | Liang |
| 8,833,809 | B2 | 9/2014 | Liang |
| 8,844,985 | B2 | 9/2014 | Liang |
| 8,870,244 | B2 | 10/2014 | Liang |
| 8,881,461 | B2 | 11/2014 | Derham |
| 9,103,144 | B2 | 8/2015 | Liang |
| 9,140,033 | B2 | 9/2015 | Wolf |
| 9,376,834 | B2 | 6/2016 | Liang |
| 9,493,970 | B2 | 11/2016 | Campbell |
| 9,816,300 | B2 | 11/2017 | Derham |
| 2006/0192391 | A1 | 8/2006 | Pettit |
| 2006/0244270 | A1 | 11/2006 | Rotondi |
| 2007/0205615 | A1 | 9/2007 | Eenigenburg |
| 2008/0012358 | A1 | 1/2008 | Liang |
| 2008/0022728 | A1 | 1/2008 | Flory |
| 2008/0169658 | A1 | 7/2008 | Wolf |
| 2010/0199726 | A1* | 8/2010 | Varney ..... E05B 65/0852 70/90 |
| 2010/0218425 | A1 | 9/2010 | Nolte |
| 2010/0263415 | A1 | 10/2010 | Ruspil |
| 2013/0214545 | A1 | 8/2013 | Wolf |
| 2013/0283695 | A1 | 10/2013 | Hollerman |
| 2016/0076282 | A1 | 3/2016 | Wolf |
| 2016/0319577 | A1* | 11/2016 | Liang ..... E05B 65/0847 |

FOREIGN PATENT DOCUMENTS

| | | |
|---|---|---|
| GB | 2 461 107 | 12/2009 |
| GB | 2 461 108 | 12/2009 |

* cited by examiner

AUTOMATICALLY RESETTING WINDOW VENT STOP WITH DUAL SAFETY FEATURES

FIELD OF THE INVENTION

The present invention relates to vent stops used to prevent a sash window or door from opening more than a desired amount, and more particularly relates to an improved vent stop that automatically resets after the sash member is slid into a closed position from an open position, and which has a child safety button that also improves resistance to unauthorized actuation of the vent stop from the outside.

BACKGROUND OF THE INVENTION

There are many different types of windows currently available. These windows include casement windows, transom windows, single hung windows, double hung windows, sliding windows, etc. Double hung windows have a pair of window sashes each of which may be raised and lowered. Each sash resides in a pair of tracks located in the master window frame, permitting the lower sash to be raised and the upper sash to be lowered. Single hung windows are similar to double hung windows except that there is only one sash that may be raised or lowered. Sliding windows and doors have sashes that are movable laterally along a track to the right or left.

Double hung windows, single hung windows, sliding windows and sliding doors have a variety of open positions in which they may be placed. While a fully opened position can be desirable for ventilation purposes there are downsides to maintaining a window in the fully opened position. One downside is security. A fully open window or door, however, can be a location for unauthorized ingress into a person's home. Moreover, a window that is opened fully can be a source of danger to small children who may climb up to the window and accidentally fall to the ground. As a result, many municipalities have enacted laws requiring the use of window restrictors that limit the opening of a window, until a safety feature is actuated.

Thus, there is a need in the art for window vent stops with improved safety features. The present invention fulfills this need.

OBJECTS OF THE INVENTION

It is an object of the invention to provide a vent stop with improved safety features.

It is another object of the invention to provide a vent stop that can automatically reset to the restricting position, after the window is moved from an unrestricted position (e.g., fully open) to a closed position or a nearly closed position.

It is a further object of the invention to provide a vent stop that requires actuation of a vent stop tumbler and actuation of a safety button to place the window into an unrestricted open position.

It is another object of the invention to provide a safety button that is configured to prevent actuation thereof by an unauthorized intruder positioned outside of the window.

Further objects and advantages of the invention will become apparent from the following description and claims, and from the accompanying drawings.

SUMMARY OF THE INVENTION

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

A vent stop is configured for use on a window or door (hereinafter referred to collectively as just a "window") to limit sliding of a sash member with respect to a master frame of the window, between a closed sash position and a partially opened sash position, where the partially opened position is between the closed position and a fully opened sash position (typically 4 inches of travel or less). The vent stop may include: a housing, a tumbler, a particularly configured safety button, and a special biasing member.

The housing is used to mount the vent stop to the window, and also has an opening into a cavity. The interior surface of the housing cavity includes a specially contoured feature. The tumbler is pivotally mounted to the housing, and includes at least a bearing surface, and a curved deflection surface. The biasing member, mounts to the tumbler, and is configured to bias one end of the tumbler to pivot outward from the housing cavity. A portion of the biasing member contacts and moves with respect to the contoured feature to selectively limit the outward pivotal travel of the tumbler between at least a first (extended) tumbler position and a second (partially extended) tumbler position. The tumbler in the first tumbler position is positioned for the sash member to contact its bearing surface and thereby restrict opening of the sash member to a partially opened sash position. In the second tumbler position, at least a substantial portion of the bearing surface is positioned within the housing cavity, while the deflection surface is outside of the housing cavity.

The safety button is slidably mounted to the housing to slide between a first button position and a second button position. Various different spring arrangements may be used to bias the safety button toward the first button position. When the safety button is in the first button position, a very small amount of pivoting of the tumbler results in a portion of the tumbler engaging a portion of the safety button, so that the safety button blocks any further pivotal movement of the tumbler toward the retracted tumbler position.

The safety button is also configured such that when in the second button position, pivoting of the tumbler is not thereby inhibited, and actuation of the second end of the tumbler by a user causes the tumbler to toggle from the first tumbler position to a retracted tumbler position where at least a substantial portion of the second end of the tumbler is positioned within the housing cavity. After the user has toggled the safety button into the second button position, and has begun to actuate the tumbler to pivot away from the first tumbler position, the safety button may be released and may be biased back toward the first button position by the spring; however, a curved surface of the tumbler may contact a cam surface of the safety button to prevent the biased sliding of the safety button back all the way into the first button position, until the tumbler pivots to return almost completely to the first tumbler position. When the tumbler is in the retracted tumbler position and the user ceases to apply a force to actuate the tumbler, the tumbler is biased by the biasing member to pivot away from the retracted tumbler position, with the biased pivotal movement of the tumbler being limited by contact of the portion of the biasing member with a portion of the contoured feature, to temporarily limit the outward pivotal biasing of the tumbler to the second tumbler position. In the second tumbler position, the bearing surface is retracted within the housing cavity and a curved portion of the tumbler remains exposed outside of the housing.

With the tumbler having been actuated to occupy the second tumbler position, movement of the sash member by the user towards a fully open position would cause the sash member to contact the curved tumbler surface, and, as a result of such contact, cause the tumbler to pivot into an intermediate tumbler position, in which the sash member is free to slide beyond the partially opened position into a fully opened position. When in the intermediate tumbler position, the tumbler is at a position between the second tumbler position and the retracted tumbler position, and more particularly, it is a position where the tumbler is biased into contact with the sash member, and is prevented from protruding further out of the vent stop housing because of its contact with the sash member.

When the sash member contacts the curved surface of the tumbler and causes the tumbler to pivot into the intermediate tumbler position, the portion of the biasing member in contact with the contoured housing feature moves from being in contact with one contour position to being in contact with another contour position, and thereat no longer limits the outward pivoting of the tumbler to the second tumbler position. When the sash member is subsequently moved back towards the closed position and passes the partially opened position, the outward pivotal travel of the biased tumbler is no longer inhibited by its contact with the sash member, and is therefore biased into the first tumbler position.

The housing may be formed to have one or more walls that extend away from a top plate, toward a bottom wall to form the housing cavity. At least a portion of the top plate overhangs beyond at least a portion of the one or more walls to create a lip, and an opening may be formed in the top plate into the cavity, through which the tumbler may pivot. The safety button may be particularly formed such that when slidably installed within the housing cavity, an exposed top surface may be substantially co-planar with a top surface of the top plate. The safety button may also be positioned in the housing adjacent to bearing surface of the tumbler, and may thereby be configured to be covered by the sash member when the sash member is in the partially opened position and in contact with the bearing surface. This may serve to prevent someone from outside the window from trying to gain unauthorized entry by toggling the safety button and the tumbler, when the window may only be opened several inches.

BRIEF DESCRIPTION OF THE DRAWINGS

The description of the various example embodiments is explained in conjunction with appended drawings, in which.

DETAILED DESCRIPTION OF THE INVENTION

Figure 1A:
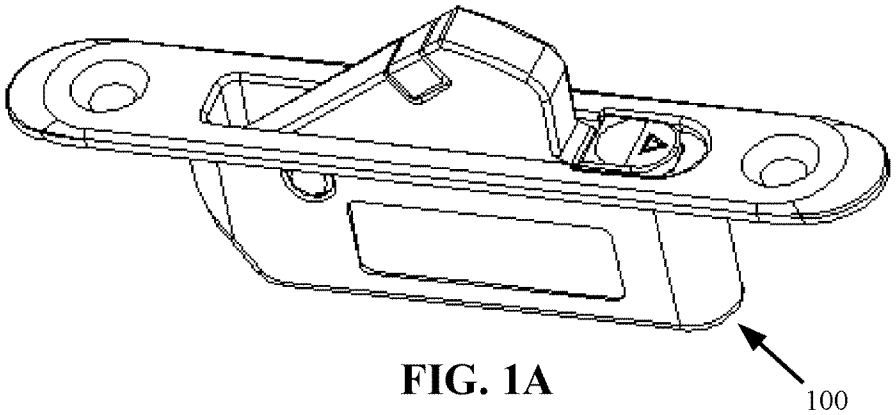
FIG. 1A is a perspective view of one embodiment of the vent stop of the present invention.

As used throughout this specification, the word "may" is used in a permissive sense (i.e., meaning having the potential to), rather than the mandatory sense (i.e., meaning must). Similarly, the words "include", "including", and "includes" mean including but not limited to.

The phrases "at least one". "one or more", and "and/or" are open-ended expressions that are both conjunctive and disjunctive in operation. For example, each of the expressions "at least one of A, B and C". "one or more of A. B. and C", and "A, B, and/or C" mean all of the following possible combinations: A alone; or B alone; or C alone; or A and B together; or A and C together; or B and C together; or A, B and C together.

Also, the disclosures of all patents, published patent applications, and non-patent literature cited within this document are incorporated herein in their entirety by reference. However, it is noted that citing herein of any patents, published patent applications, and non-patent literature is not an admission as to any of those references constituting prior art with respect to the present invention Furthermore, the described features, advantages, and characteristics of any particular embodiment disclosed herein, may be combined in any suitable manner with any of the other embodiments disclosed herein.

Additionally, any approximating language, as used herein throughout the specification and claims, may be applied to modify any quantitative or qualitative representation that could permissibly vary without resulting in a change in the basic function to which it is related. Accordingly, a value modified by a term such as "about" is not to be limited to the precise value specified, and may include values that differ from the specified value in accordance with applicable case law. Also, in at least some instances, a numerical difference provided by the approximating language may correspond to the precision of an instrument that may be used for measuring the value. A numerical difference provided by the approximating language may also correspond to a manufacturing tolerance associated with production of the aspect/feature being quantified. Furthermore, a numerical difference provided by the approximating language may also correspond to an overall tolerance for the aspect/feature that may be derived from variations resulting from a stack up (i.e., the sum) of multiple individual tolerances.

It is further noted that any use herein of relative terms such as "top," "bottom," "upper," "lower," "vertical," and "horizontal" are merely intended to be descriptive for the reader, based on the depiction of those features within the figures for one particular position of the device, and such terms are not intended to limit the orientation with which the device of the present invention may be utilized.

The window vent stop described hereinafter may be used on a sash window or door to limit sliding of a sash member, with respect to a master frame of the window/door, between a closed position and a partially opened ("restricted") position, where the partially opened position is between the closed position and a fully opened position. The vent stop may be installed on the window such that in the partially opened position, the sash member may be restricted to a maximum amount of travel of roughly four inches, which may leave an opening small enough to prevent accidental egress by a small child or infant, and may also deter unauthorized ingress by an intruder. The vent stop may alternatively be positioned on the window to restrict the sash member to other amounts of travel, being greater than or less than four inches.

In accordance with at least one embodiment of the present invention, a window vent stop 100 may broadly include a housing 110, a safety button 130, a biasing member 150, and a tumbler 170. The window vent stop 100 may optionally include a colored warning signal, which may be in the form of a colored signal member 190 that may be secured to the tumbler 170, or may instead be painted on a portion of the tumbler.

Figure 1B:
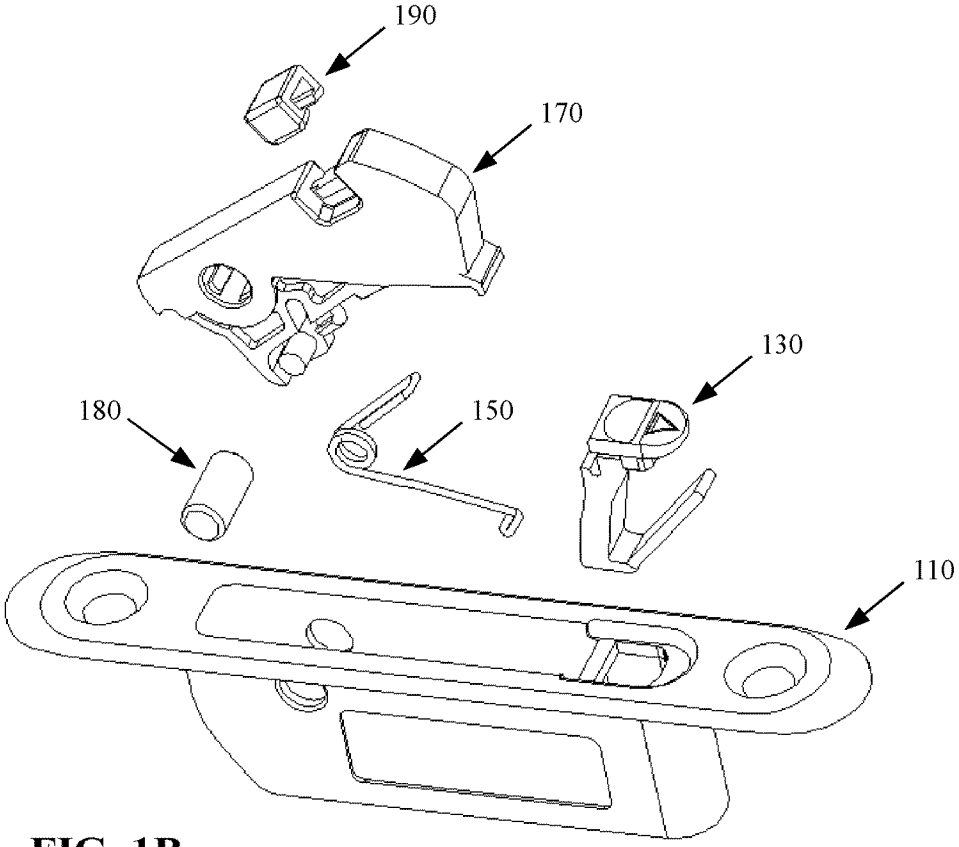
FIG. 1B is an exploded view of the component parts of the vent stop embodiment of FIG. 1A.
Figure 2:
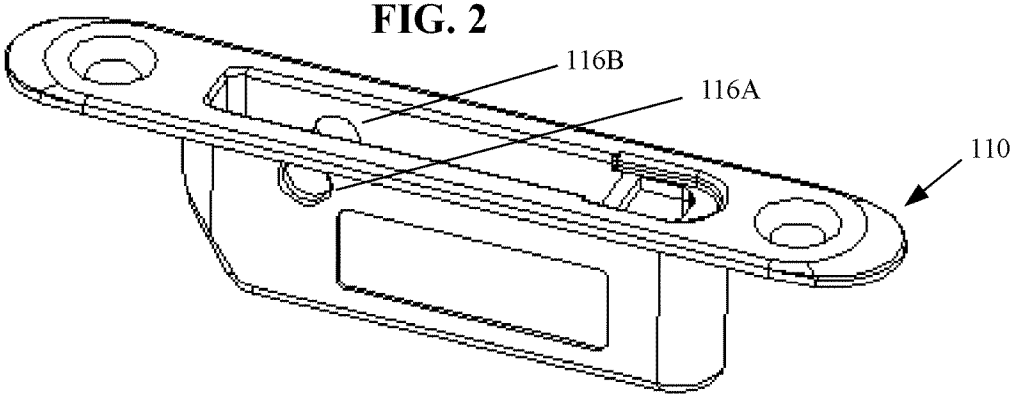
FIG. 2 is a perspective view of the housing of the vent stop of FIG. 1A.

The housing 110, safety button 130, biasing member 150, and tumbler 170 are shown in the exploded view of FIG. 1B, and are shown after being assembled to form the vent stop 100 in FIG. 1A.

Figure 4:
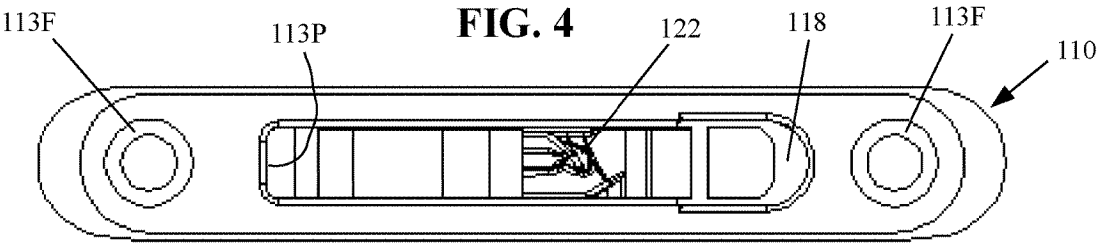
FIG. 4 is a top view of the housing of FIG. 2.
Figure 3:
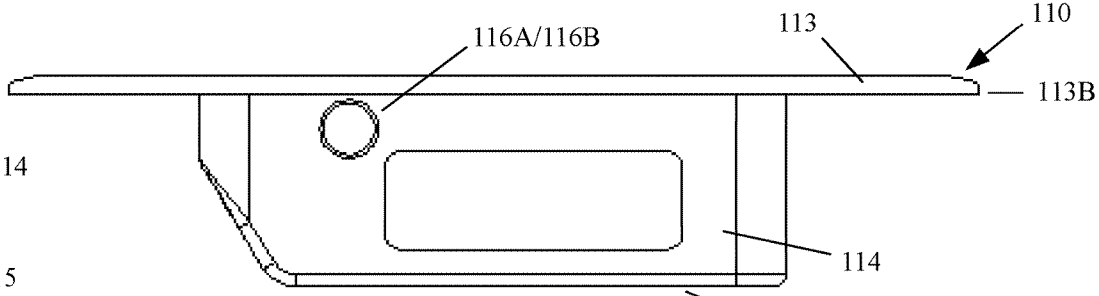
FIG. 3 is a front view of the housing of FIG. 2.
Figure 5:
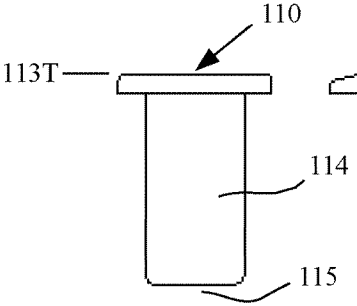
FIG. 5 is an end view of the housing of FIG. 2.
Figure 6:
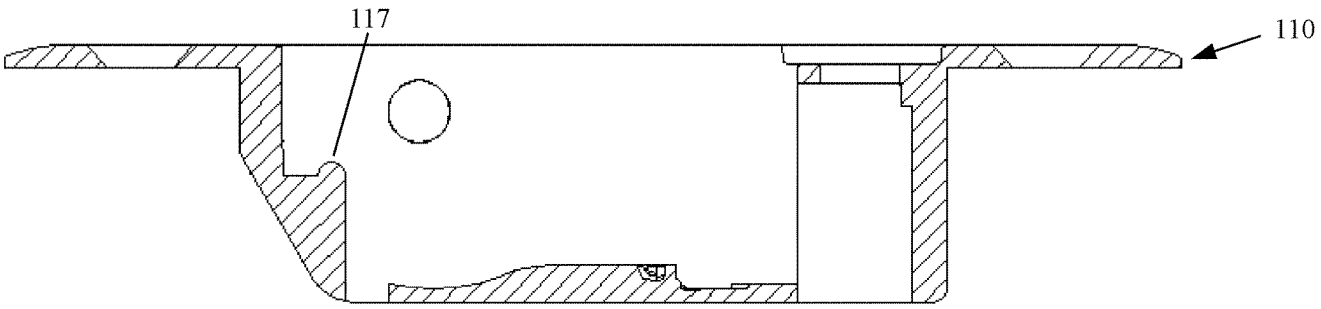
FIG. 6 is a cross-sectional view through the housing of FIG. 2.
Figure 8:
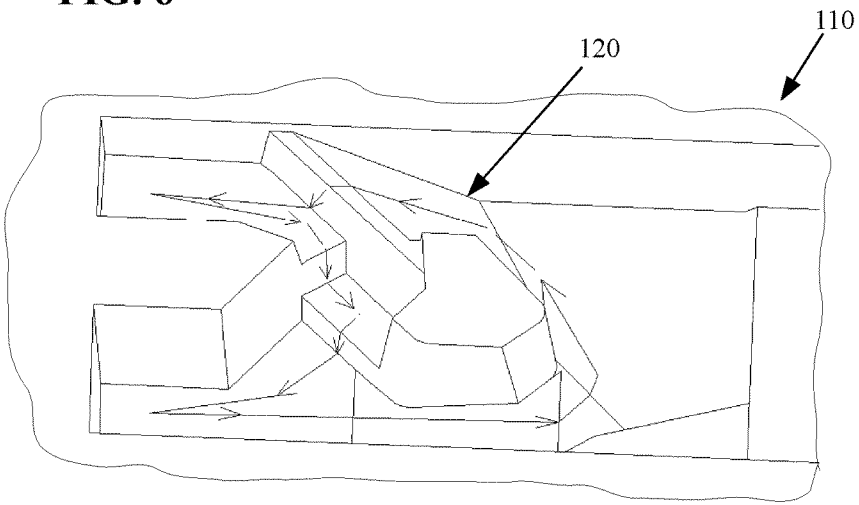
FIG. 8 is an enlarged perspective view of the contoured feature in the housing cavity shown in FIG. 7.
Figure 7:
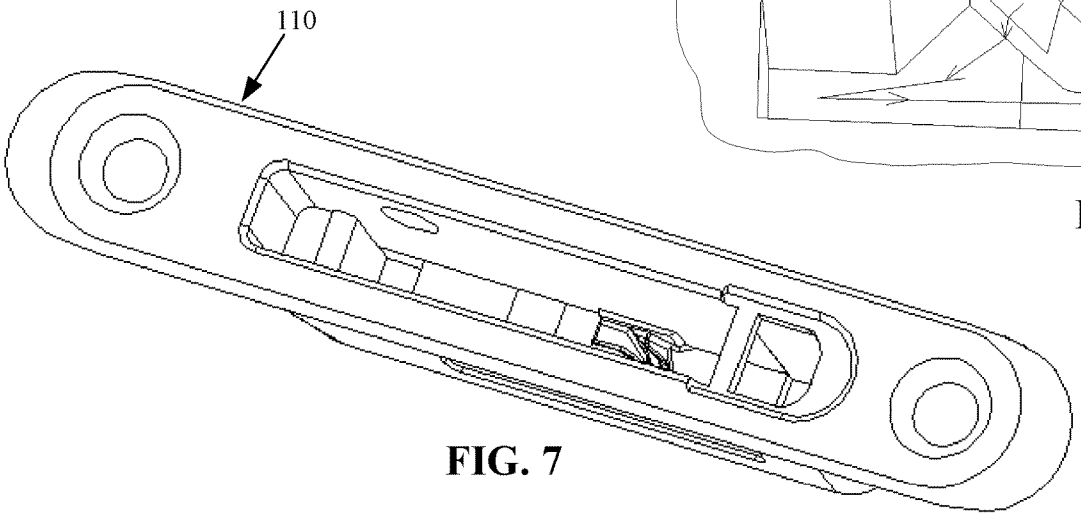
FIG. 7 is a second perspective view of the housing of the vent stop of FIG. 1A, showing a contoured feature within a cavity therein.
Figure 9:
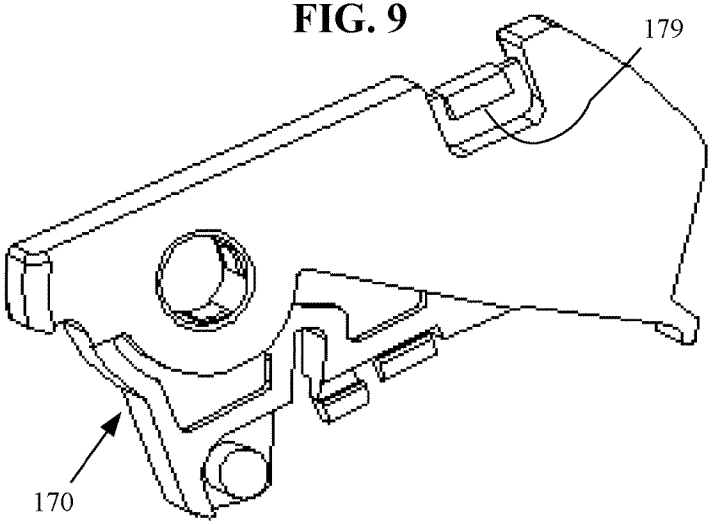
FIG. 9 is a perspective view of the tumbler of the vent stop of FIG. 1A.

The housing 110 may include a top plate 113, and one or more side walls 114 joined to and extending from a bottom surface 113B of the top plate. The one or more side walls 114 may be one continuous wall, or may instead be separate discrete side wall portions that may be suitably joined together (e.g., bonded, welded, etc.). As seen in FIG. 3 and FIG. 5, at least a portion of the top plate 113 may overhang beyond at least a portion of the one or more side walls 114 to create a lip. A bottom wall 115 may connect to the one or more side walls 114 at a position distal from the top plate 113 to form a cavity that may be bounded by the interior surfaces of the top plate, the bottom wall, and the one or more side walls. The one or more side walls 114 may smoothly transition into the bottom wall 115. Moreover, the top plate 113, the one or more side walls 114, and the bottom wall 115 may be integrally formed as a single unitary part, such as by an injection molding process, or by a casting process. As seen in FIG. 4, an opening 113P may be formed in the top plate 113 to expose the housing cavity. The housing 110 may be configured to mount the vent stop 100 into an opening in the window using any suitable mounting features known in the art. In one embodiment, the top plate 113 may be formed to include a pair of orifices 113F, each of which may receive a screw or other fastener to mechanically fasten the vent stop to the window. A portion of the housing 110 may include a particularly contoured feature. In one embodiment, as seen in FIGS. 6-8, the contoured feature 120 of the housing 110 may be formed in a portion of the bottom wall 115 within the housing cavity. The contoured feature 120 may include a series of ramps, ridges and valleys that may form a track, which is discussed further hereinafter in relation to the biasing member 150.

Figure 12:
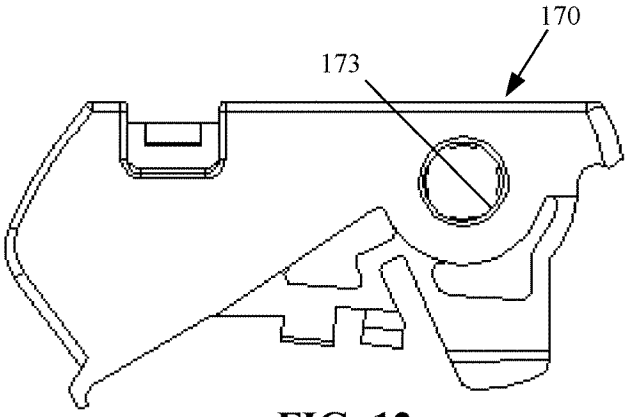
FIG. 12 a rear view of the tumbler of FIG. 9.
Figure 14:
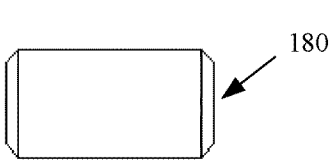
FIG. 14 is a front view of the hinge pin of FIG. 13.
Figure 13:
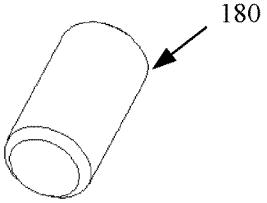
FIG. 13 is a perspective view of a hinge pin used to mount the tumbler to the housing for the vent stop of FIG. 1A.
Figure 11:
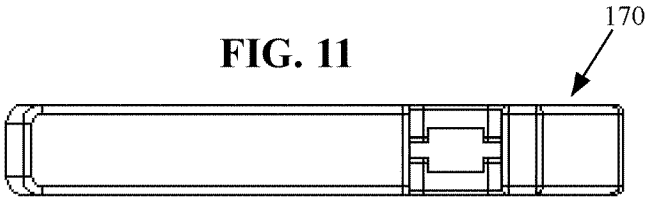
FIG. 11 is a top view of the tumbler of FIG. 9.
Figure 10:
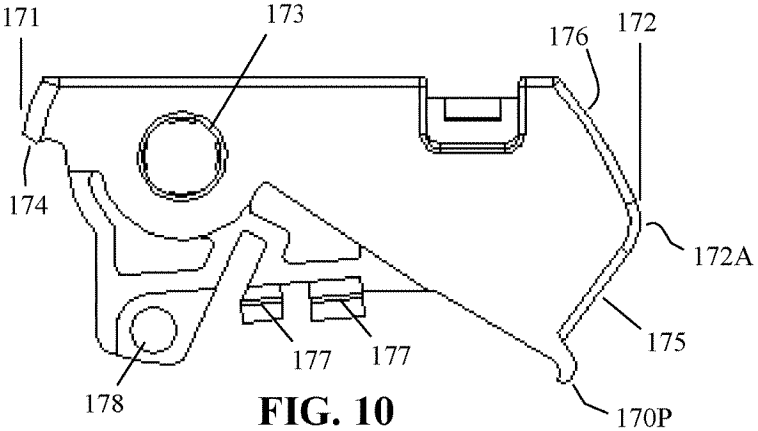
FIG. 10 is a front view of the tumbler of FIG. 9.
Figure 15:
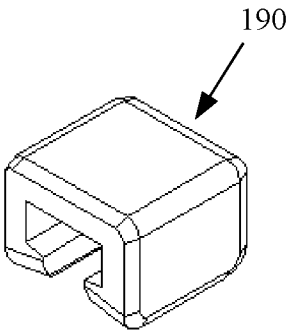
FIG. 15 is a perspective view of an optional colored warning clip used on the vent stop of FIG. 1A.
Figure 17:
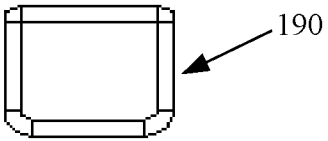
FIG. 17 is a side view of the colored warning clip of FIG. 15.
Figure 16:
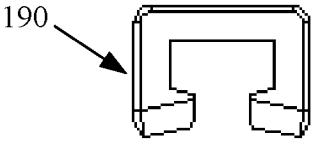
FIG. 16 is an end view of the colored warning clip of FIG. 15.
Figure 18:
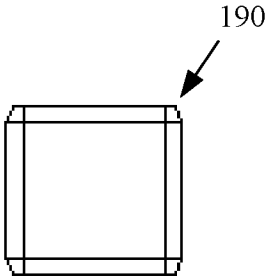
FIG. 18 is a top view of the colored warning clip of FIG. 15.
Figure 21:
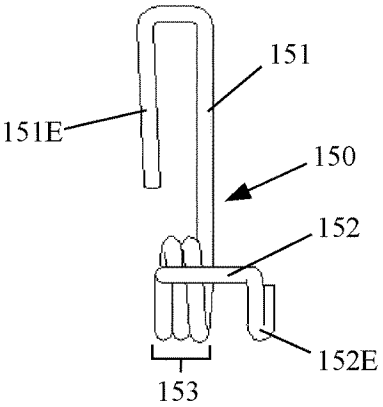
FIG. 21 is a side view of the biasing member of FIG. 19.
Figure 19:
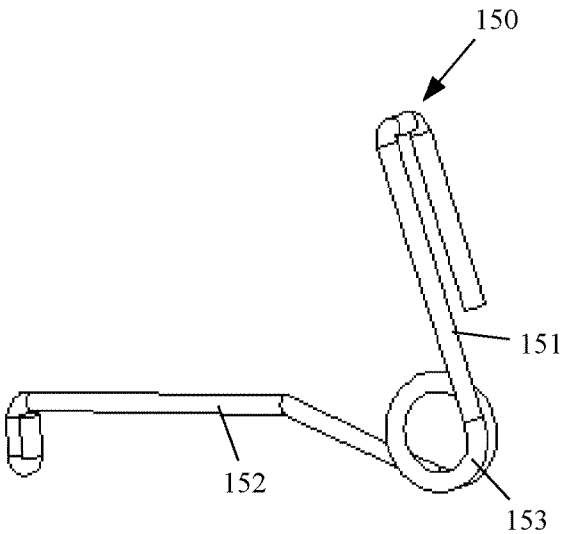
FIG. 19 is a perspective view of the biasing member of the vent stop of FIG. 1A.
Figure 20:
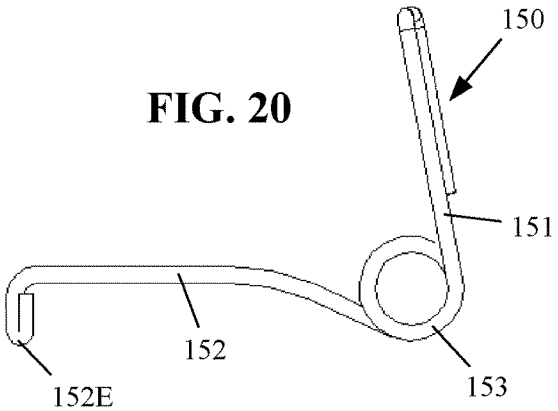
FIG. 20 is a front view of the biasing member of FIG. 19.
Figure 22:
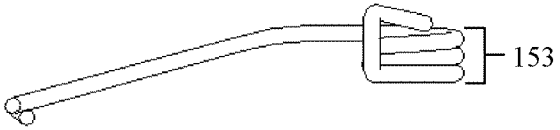
FIG. 22 is a bottom view of the biasing member of FIG. 19.
Figure 23:
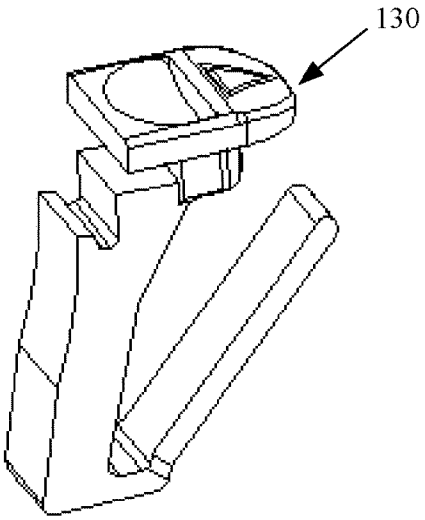
FIG. 23 is a perspective view of a first embodiment of a safety button usable on the vent stop of FIG. 1A.
Figure 27:
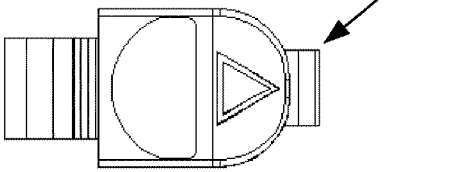
FIG. 27 is a top view of the safety button embodiment of FIG. 23.
Figure 25:
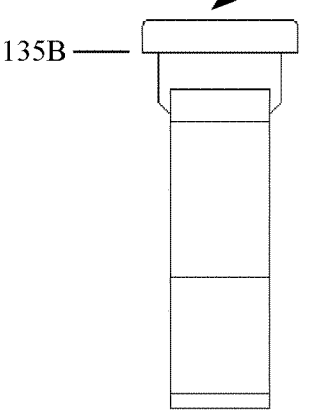
FIG. 25 is a first side view of the safety button embodiment of FIG. 23.
Figure 24:
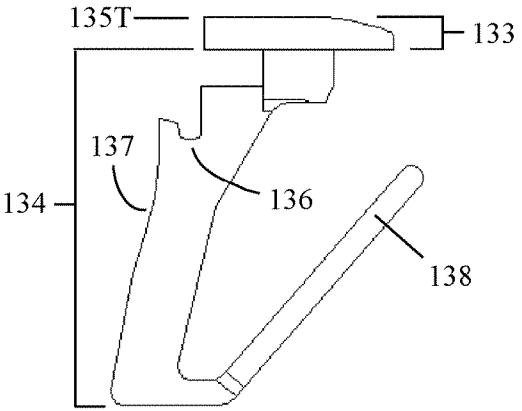
FIG. 24 is a front view of the safety button embodiment of FIG. 23.
Figure 26:
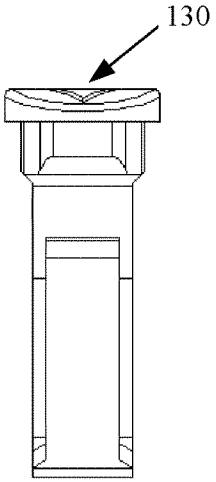
FIG. 26 is a second side view of the safety button embodiment of FIG. 23.

The tumbler 170 is shown in detail in FIGS. 9-12. The tumbler 170 may extend from a first end 171 to a second end 172. The tumbler 170 may be pivotally mounted to the housing 110 in any suitable manner. In one embodiment the tumbler 170 may have an orifice 173 that may be disposed in closer proximity to the first end 171 than the second end 172, which orifice may pivotally receive the cylindrical pin 180, which may be secured to the mounting orifices 116A and 116B in the housing 110. In another embedment, a pair of pins may be integrally formed with the tumbler, and may respectively protrude from each of the two sides of the tumbler, and may be pivotally received in the mounting orifices 116A and 116B. The first end 171 of the tumbler 170 may terminate in a protruding surface 174 that may be configured, when the tumbler is pivotally mounted to the housing 110, to contact a correspondingly shaped surface 117 of the housing (see FIG. 6) to limit/stop outward pivotal travel of the tumbler to an extended tumbler position (see FIG. 41). The second end 172 of the tumbler 170 may have an apex 172A at the transition between a bearing surface 175 and a deflection surface 176. The bearing surface 175 may be substantially flat, so that a substantial portion of its entire length may bear directly against a sliding sash member 99 when positioned to restrict movement of the sash member (see FIG. 45). In one embodiment, the deflection surface 176 may be flat, and in another embodiment the deflection surface may be curved, as shown in FIGS. 10 and 12. The apex 172A may be formed by a curved surface that may transition between the bearing surface 175 and the deflection surface 176. In one embodiment, the tumbler 170 may be formed with one or more recesses 177 within which one end of the biasing member 150 may be secured, which biasing member may be a particularly formed torsion spring. In another embodiment, the tumbler 170 may also be formed with a cylindrical protrusion 178 which may be used for mounting of a helical coil portion of the torsion spring. When the separate colored signal member 190 shown in FIGS. 15-18 is utilized, the tumbler may include one or more recessed protrusions 179 to mount the signal member thereto.

Figure 28:
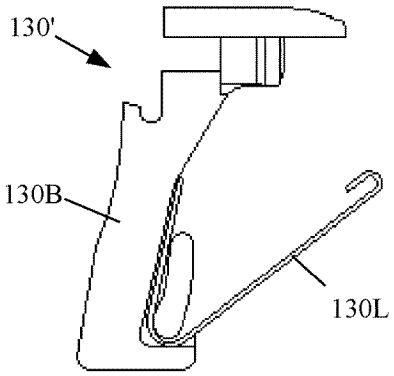
FIG. 28 is a side view of a second safety button embodiment usable on the vent stop of FIG. 1A.
Figure 32:
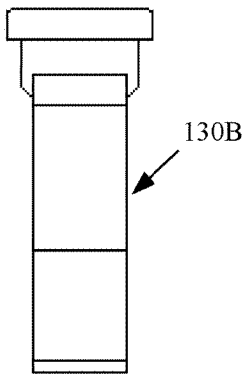
FIG. 32 is a second side view of the safety button body of FIG. 29.
Figure 33:
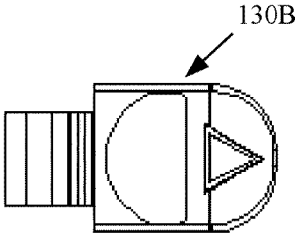
FIG. 33 is a top view of the safety button body of FIG. 29.
Figure 30:
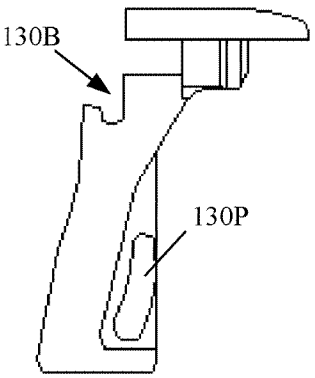
FIG. 30 is a front view of the safety button body of FIG. 29.
Figure 36:
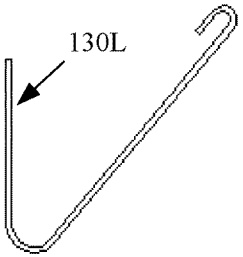
FIG. 36 is a side view of the leaf spring of FIG. 34.
Figure 31:
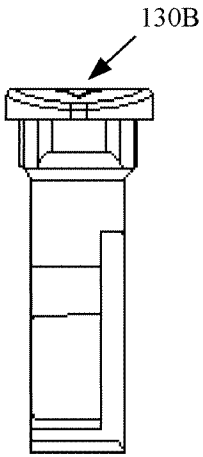
FIG. 31 is a first side view of the safety button body of FIG. 29.
Figure 35:
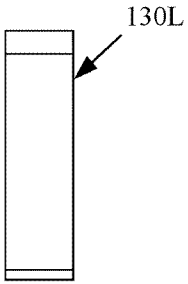
FIG. 35 is a front view of the leaf spring of FIG. 34.
Figure 29:
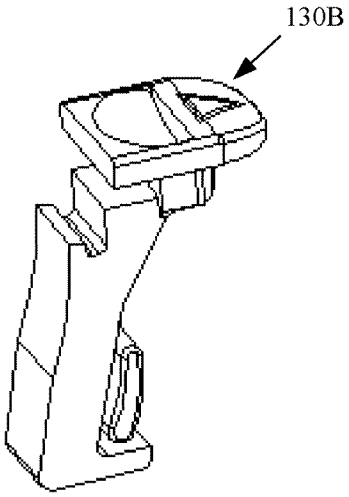
FIG. 29 is a perspective view of the button body used for the safety button assembly of FIG. 28.
Figure 34:
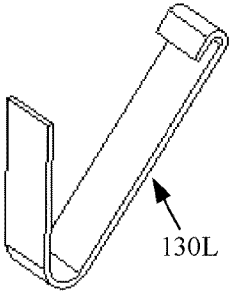
FIG. 34 is a perspective view of a leaf spring used for the safety button assembly of FIG. 28.
Figure 37:
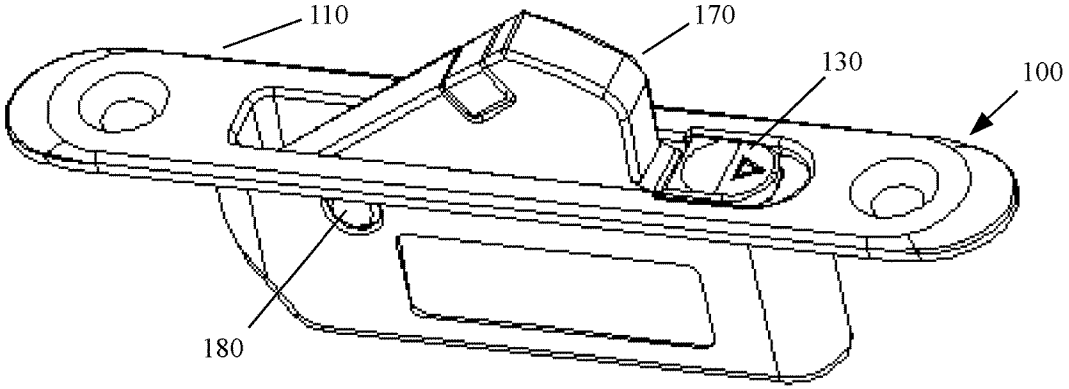
FIG. 37 is a second perspective view of the vent stop embodiment of FIG. 1A.
Figure 39:
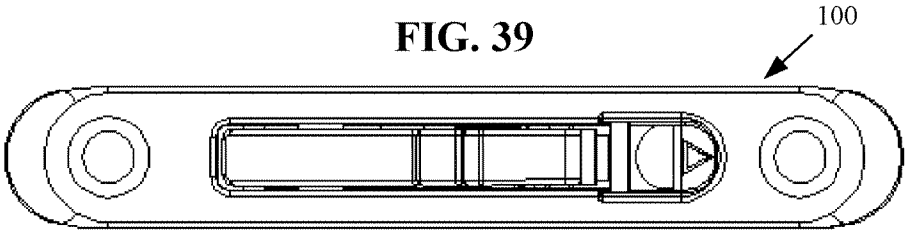
FIG. 39 is a top view of the vent stop embodiment of FIG. 37.
Figure 38:
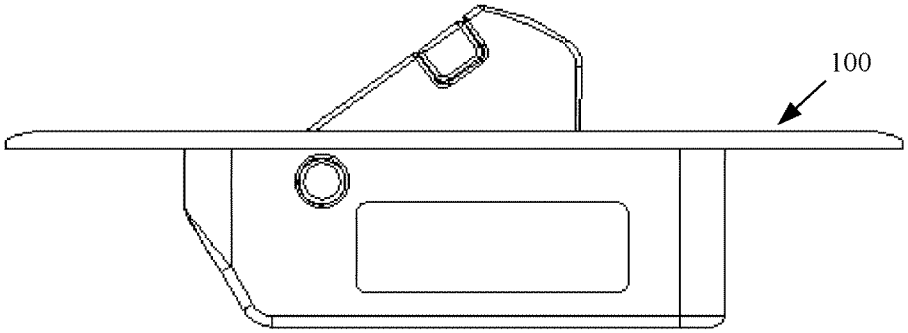
FIG. 38 is a front view of the vent stop embodiment of FIG. 37.
Figure 40:
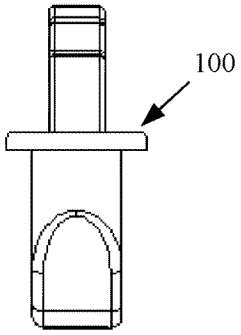
FIG. 40 is an end view of the vent stop embodiment of FIG. 37.
Figure 41:
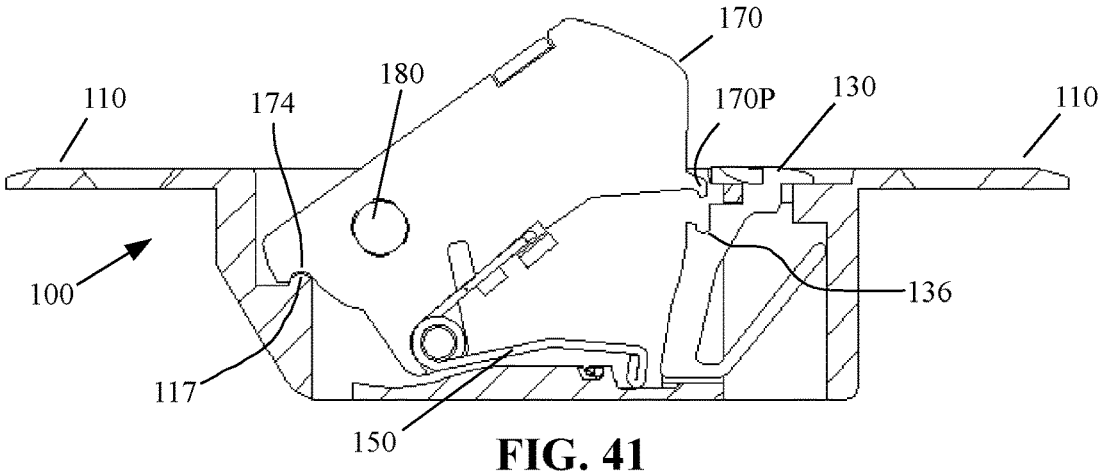
FIG. 41 is a cross-sectional view through the vent stop of FIG. 37, shown with the tumbler in a first tumbler position, and the safety button in a first button position.
Figure 43:
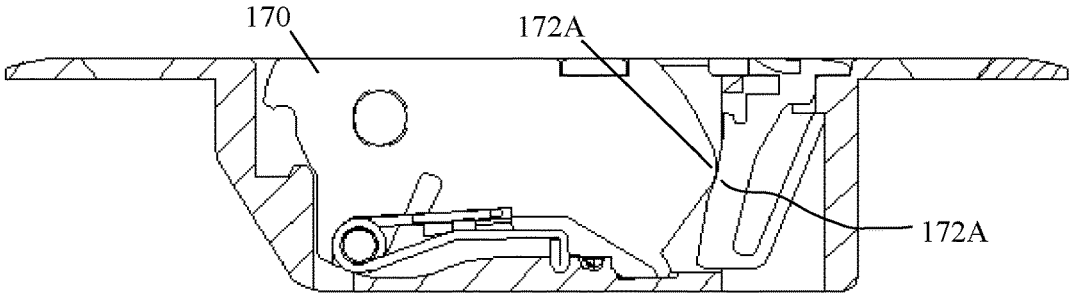
FIG. 43 is the cross-sectional view of FIG. 41, but is shown after the safety button had been moved from the first button position to the second button position, after the tumbler has been actuated to pivot into a fully retracted position, and the safety button is released and is biased into contact with the tumbler.

The safety button 130 is shown in detail in FIGS. 23-27, and may have a head portion 133 and a body portion 134. The safety button 130 may be slidably mounted to the housing 110 in any suitable manner, to slide between a first button position (FIG. 41) and a second button position (FIG. 43). In one embodiment, the bottom surface 135B of the head portion 133 of the safety button 130 may bear up against a recess and lip 118 formed in the housing 110 (see FIG. 4). As seen in FIGS. 41 and 43, a top surface 135T of the safety button 130 may be exposed and visible when the safety button is installed in the housing 110, and the top surface of the safety button may also be substantially co-planar with a top surface 113T of a top plate 113 of the housing 110, which aspect is discussed further hereinafter with respect to operation of the vent stop. A recess 136 may be formed in a portion of the safety button for interacting with and receiving a portion 170P of the tumbler 170, as discussed hereinafter. One side of the body portion 134 of the safety button 130 may be formed to have a curved cam surface 137 that may also interact with a portion of the tumbler 170. The safety button 130 may be biased into the first button position, and may be so biased using one of two different arrangements. In one embodiment, the safety button 130 may be formed with a flexible flange 138 that may extend away from a bottom of the body portion 134 being distal from the head portion 133. The flexible flange 138 may be deflected from contact with the housing 110 to store strain energy when the safety button 130 is actuated by a user to move from the first button position into the second button position (compare FIGS. 41 and 43). When the safety button 130 is no longer maintained in the second button position by the user, the deflected flexible flange 138 expends the stored energy to return to the un-deflected position by pushing against the housing 110, which biases and moves the safety button back to the first button position. In a second embodiment, a safety button assembly 130', shown in FIG. 28, may have a button member 130B formed similar to safety button 130, but may instead have a separate leaf spring 130L secured thereto using a protrusion 130P to provide the biasing, rather than the integral flexible flange 138.

The biasing member 150 is shown in detail in FIGS. 19-22. The biasing member 150 may be formed as a torsion spring having a first arm 151 and a second arm 152 between which may be a helical coil portion 153. The helical coil portion 153 may mount to the cylindrical protrusion 178 on the tumbler 170, and the first arm 151 may mount to the recess(s) 177 of the tumbler. The first arm 151 may have a couple of bends to form a U-shape, as there may be several recesses 177 that may even be formed on opposite sides of the tumbler 170 to accommodate the first arm wrapping around to be secured thereto to prevent being detached during pivotal movements of the tumbler. The second arm 152 may terminate in a flat end, or a rounded end, or may have a tight 180 degree bend upon itself to form a curved end 152E for interaction with the contoured feature 120 on the housing 110, as discussed hereinafter.

Several views of the assembled vent stop 100 are shown in FIGS. 37-40, and operation of the vent stop may be seen in the cross-sectional views shown in FIGS. 41-61.

FIGS. 41, 42, 43, and 44 illustrate four principle positions of the vent stop 100 elements that may be achieved through actuation of a user, without any contact of the sash member therewith.

Figure 42:
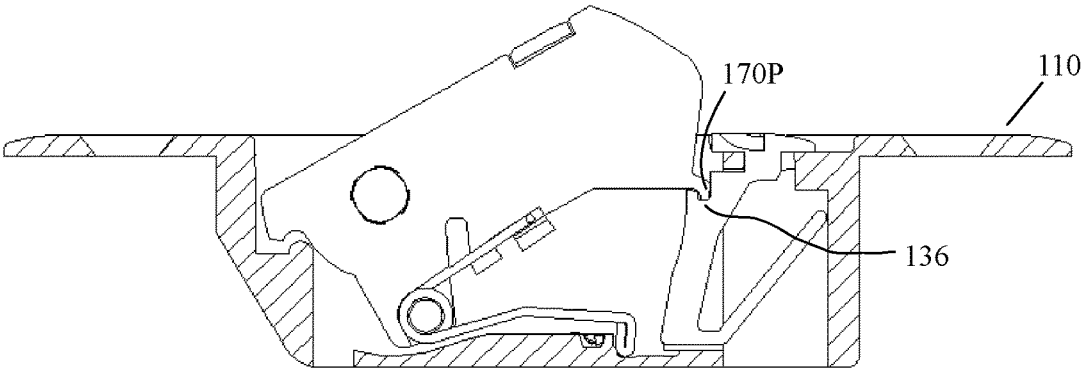
FIG. 42 is the cross-sectional view of FIG. 41, but is shown after the tumbler has been pivoted into the housing cavity a very small amount and is inhibited from pivoting further due to a protrusion on the tumbler contacting and engaging a corresponding feature on the safety button, while in the first button position.

In FIG. 41 the vent stop 100 is shown with the biasing member 150 biasing the tumbler 170 to pivot out of the housing cavity into an extended position, which outward biased travel may be limited to the extended position shown therein by contact of the protruding surface 174 of the tumbler with the surface 117 of the housing. The safety button 130 is shown in the first button position. As seen in FIG. 42, with the safety button 130 in the first button position, if the user actuates the tumbler 170, its pivotal movement is blocked by the safety button 130. The protrusion 170P on the tumbler 170 may be particularly formed with the narrow profile shown to contact and become engaging within the recess 136 of the safety button 130, while in the first button position. The position and extent of the protrusion 170P may be formed so as to permit a small amount of pivotal travel of the tumbler 170 before being blocked by the safety button 130 (see the gap in FIG. 41 between the protrusion 170P and the recess 136). The safety button 130 thus provides an added safety precaution against unsafe actuation of the tumbler 170 by an unattended child. An additional safety feature is provided by the narrow profile of the protrusion 170P, in that in the case where the window may have been opened fully after the vent stop was actuated as described hereinafter, but the vent stop was toggled out of sequence with the fully opened window to be as shown in FIG. 41, the window may still be slid forcefully closed, causing a small amount of tumbler pivoting and subsequent buckling of the protrusion under the force applied thereto, causing temporary movement of the tumbler into the retracted position. The vent stop 100 may still function thereafter, without the added dual action child safety feature being provided by safety button 130 due to the buckled protrusion 170P of the tumbler 170.

Note that the colored signal member 190 is intended to serve as an intuitive motivator to signal the user of the window to again toggle the tumbler 170 that was pivoted out of sequence into the extended position while the sash member was fully opened, so that it pivots from the extended position to the partially extended tumbler position before the sash member is closed. The colored signal member 190 may additionally or alternatively serve as an intuitive motivator to signal the user of the window to toggle the tumbler 170 when seeking to open the sash member from the closed position.

FIG. 43 is the cross-sectional view of the vent stop 100 of FIG. 41, but is shown after the safety button 130 had been actuated to slide from the first button position to the second button position, after the tumbler 170 had been actuated to pivot into a fully retracted position, and after the safety button is released and is biased toward the first button position to the point where the curved cam surface 137 of safety button 130 contacts the apex 172A of the tumbler.

Figure 44:
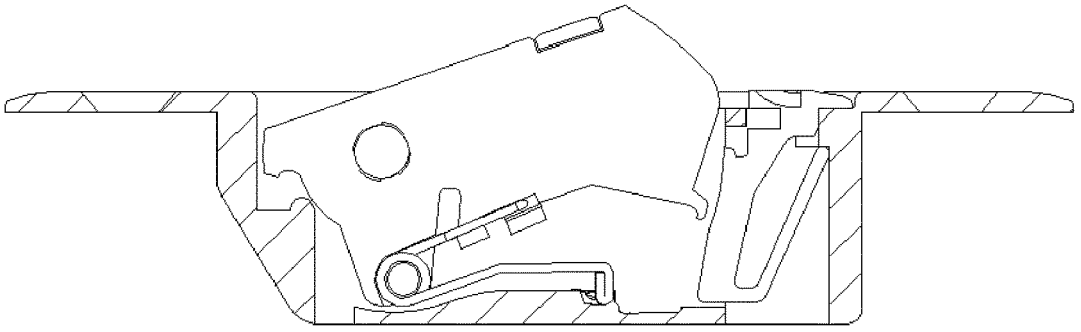
FIG. 44 is the cross-sectional view of FIG. 43, but is shown after the tumbler is no longer being actuated by the user, and the biasing member biases the tumbler to pivot outwardly, but only up until the tumbler reaches a second (partially extended) tumbler position.
Figure 42A:
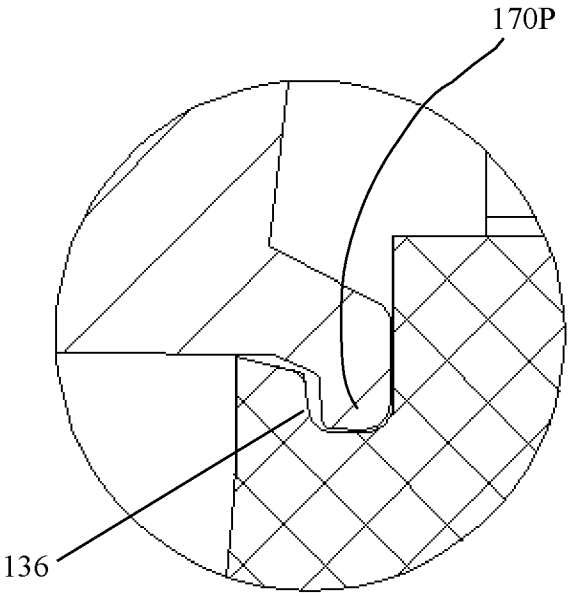
FIG. 42A is an enlarged detail view of the protrusion on the tumbler contacting and engaging a corresponding feature on the safety button, as shown in FIG. 42.

FIG. 44 is the cross-sectional view of FIG. 43, but is shown after the tumbler 170 is no longer being actuated by the user to occupy the retracted position, and the biasing member 150 has biased the tumbler to pivot outwardly, but only up until the tumbler reaches a partially extended tumbler position, due to interaction of the curved end 153E of the second arm 153 of the biasing member 150 with the contoured housing feature 120. The interaction between the curved end 153E of the second arm 153 of the biasing member 150 and the contoured housing feature 120 may be understood from FIGS. 45-61, which also show the interaction of the sash member 99 with respect to the vents stop 100.

Figure 46:
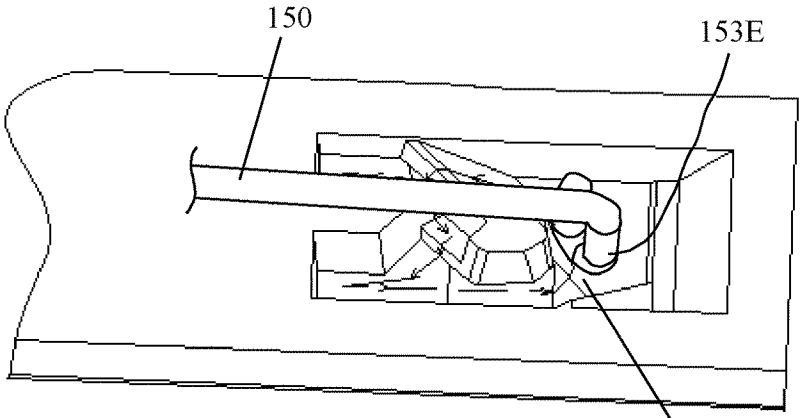
FIG. 46 is an enlarged perspective view of the housing interior, showing the end of the biasing member in contact with the contoured housing feature of FIG. 7 at a first contact position that corresponds to the position of the tumbler shown in FIG. 45.
Figure 45:
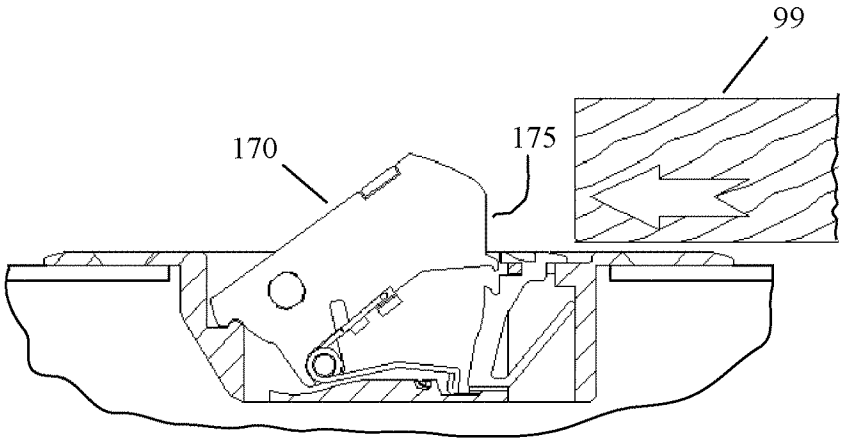
FIG. 45 is the cross-sectional view of the vent stop of FIG. 41, with the tumbler shown in the first (extended) tumbler position, but is also shown with a sliding sash member being moved towards the bearing surface of the tumbler.

FIG. 45 is the cross-sectional view of the vent stop 100 that is shown in FIG. 41, with the tumbler shown in the extended tumbler position, but also shows the sliding sash member 99 being moved towards the bearing surface 176 of the tumbler. When the tumbler 170 is in the extended tumbler position, the curved end 153E of the second arm 153 of the biasing member 150 is at a first contact point 121 on the contoured feature 120 of the housing 110, as shown in FIG. 46.

Figure 48:
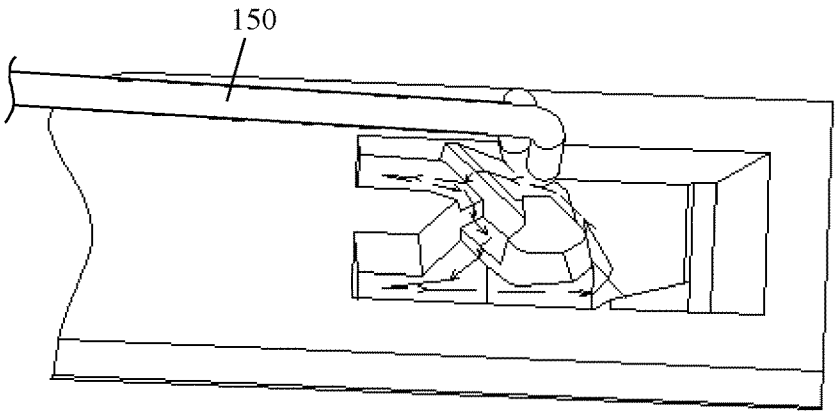
FIG. 48 is the perspective view of FIG. 46, showing the end of the biasing member having moved slightly along the contoured housing feature due to the slightly changed position of the tumbler shown in FIG. 47.
Figure 47:
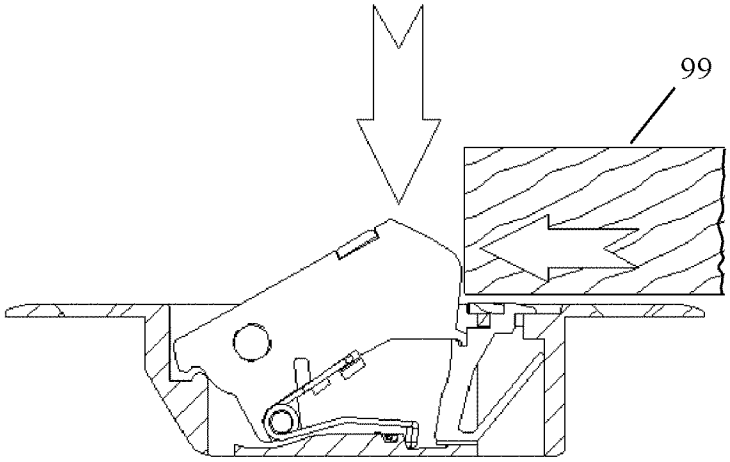
FIG. 47 is the cross-sectional view of FIG. 45, but is shown after the sash member has contacted the bearing surface of the tumbler, and after a person has attempted to actuate the tumbler to pivot into the housing cavity, but is prevented from any significant amount of pivotal movement because of contact of the tumbler protrusion with the safety button.

If the user (or an unattended child) attempts to actuate the tumbler 170 while the safety button 130 is in the first button position, as shown in FIG. 47, the protrusion 170P on the tumbler 170 will block any substantial inward pivoting of the tumbler, and movement of the sash member 99 towards the fully open position will still be blocked due to its contact with a portion the bearing surface 176 and/or the tumbler apex 172A. It is noted that the exposed surface of the safety button 130, being lower than or nearly co-planar with a top surface of the housing top plate 113, may be covered by the slightly opened sash member 99, preventing actuation of the safety button, particularly by an intruder seeking to gain unauthorized access through the slightly opened window, which is an added safety feature of vent stop 100. FIG. 48 shows the curved end 153E of the second arm 153 of the biasing member 150 having moved slightly along the contoured housing feature 120 away from the first contact point 121, due to the slightly changed position of the tumbler 170.

Figure 50:
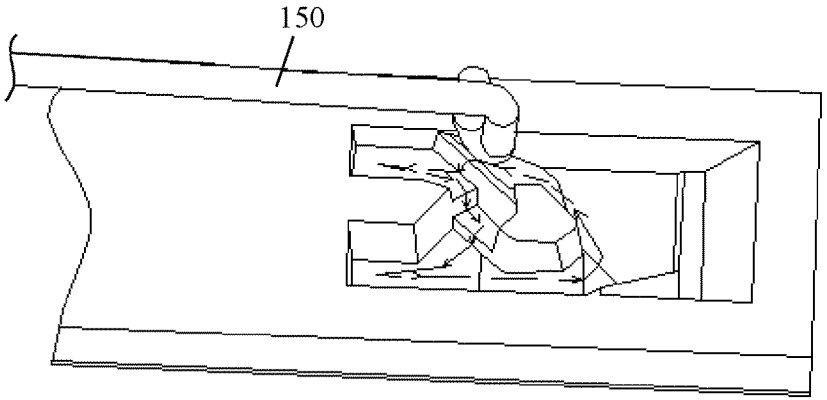
FIG. 50 is the perspective view of FIG. 46, but showing the end of the biasing member having moved along the contoured housing feature away from the first contact point, due to the changed position of the tumbler shown in FIG. 49.
Figure 49:
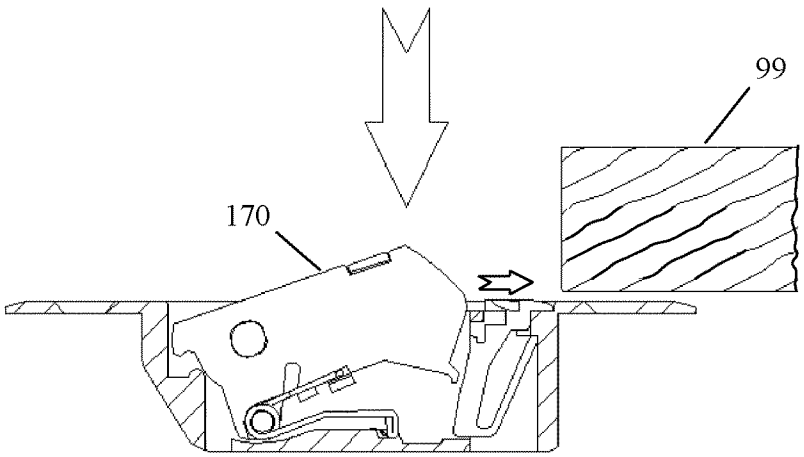
FIG. 49 is the cross-sectional view of FIG. 45, but is shown after the user has moved the safety button into the second button position and actuated the tumbler to pivot part way into the housing cavity.

FIG. 49 is the cross-sectional view of FIG. 47, but is shown after the sash member 99 has been backed away from the bearing surface 176 of the tumbler 170 to expose the safety button 130, after the user has actuated the safety button to slide into the second button position, and has also actuated the tumbler to pivot part way into the housing cavity. FIG. 50 shows the curved end 153E of the second arm 153 of the biasing member 150 having moved along the contoured housing feature away from the first contact point 121, due to the changed position of the tumbler shown in FIG. 49, with such pivotal tumbler movement causing the curved end 153E just prior to crossing a ridge of the contour 120.

Figure 52:
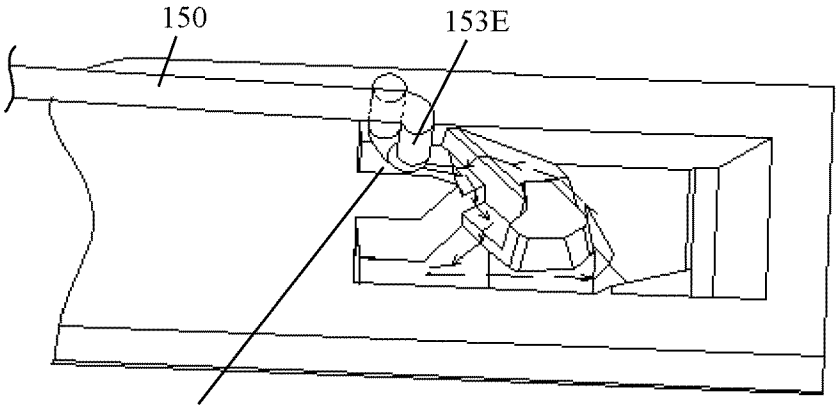
FIG. 52 is the perspective view of FIG. 50, but showing the end of the biasing member having moved further along the contoured housing feature away from the first contact point and over a guide wall into a second contact point, due to the changed position of the tumbler shown in FIG. 51.
Figure 51:
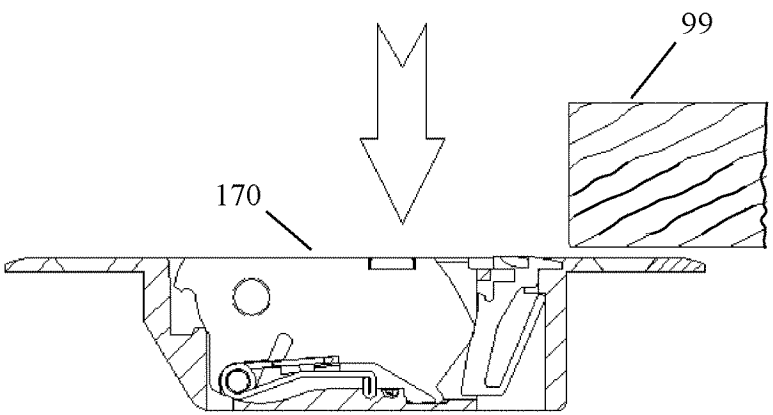
FIG. 51 is the cross-sectional view of FIG. 49, but is shown after the user has actuated the tumbler to pivot into a fully retracted position within the housing cavity and has also subsequently released the safety button for it to be biased into contact with the tumbler.

In FIG. 51, the user has continued to actuate the tumbler 170 so that it pivots into a fully retracted position within the housing cavity, and has also subsequently ceased to actuate the safety button 130, resulting in its cam surface 137 being biased into contact with the apex 172A of the tumbler. FIG. 52 is the perspective view of FIG. 50, showing the curved end 153E of the second arm 153 of the biasing member 150 having moved further along the contoured housing feature away from the first contact point 121 and over a ridge of a guide wall to reach a second contact point 122, due to the changed position of the tumbler shown in FIG. 51.

Figure 54:
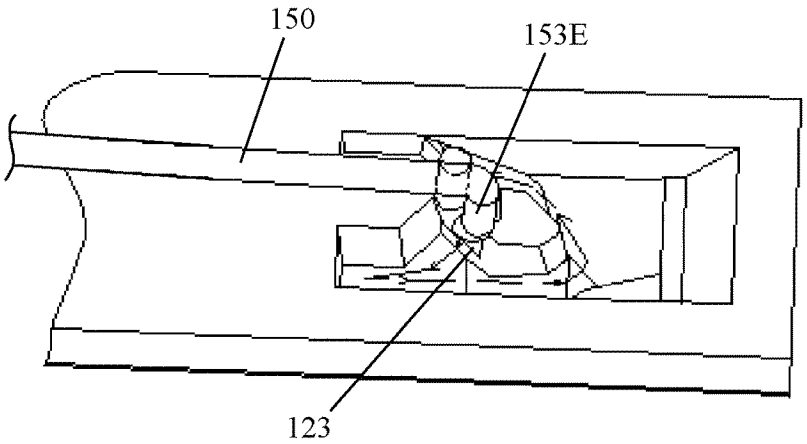
FIG. 54 is the perspective view of FIG. 52, but showing the end of the biasing member having moved further along the contoured housing feature by following a guide wall into a third contact position, due to the changed position of the tumbler shown in FIG. 53.
Figure 53:
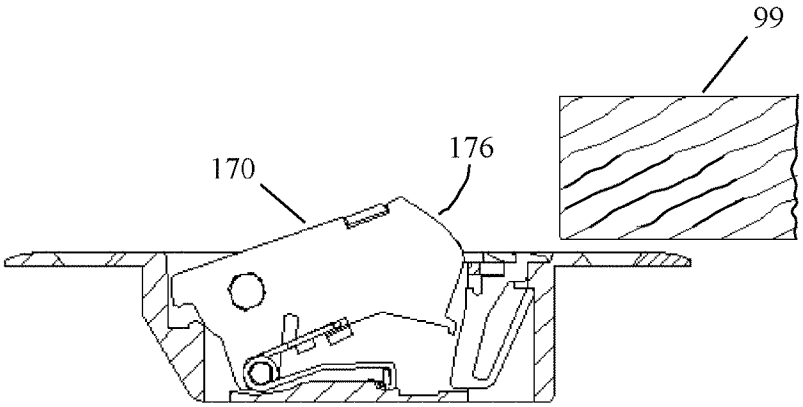
FIG. 53 is the cross-sectional view of FIG. 51, but is shown after the user has ceased actuation of the tumbler, and it has been biased by the basing member to pivot into the partially extended tumbler position.

FIG. 53 is the cross-sectional view of FIG. 51, but is shown after the user has ceased actuation of the tumbler 170, and the tumbler has thereafter been biased by the basing member 150 to pivot into a partially extended tumbler position. FIG. 54 is the perspective view of FIG. 52, showing the curved end 153E of the second arm 153 of the biasing member 150 having moved further along the contoured housing feature 120 after following a guide wall into a third contact position 123, due to the changed position of the tumbler shown in FIG. 53. At the third contact position 123, the curved end 153E of the second arm 153 of the biasing member 150 is nestled in a recess that prevents movement towards the first contact position 121, and thus prevents the tumbler from being biased further than the partially extended tumbler position of FIG. 53.

Figure 56:
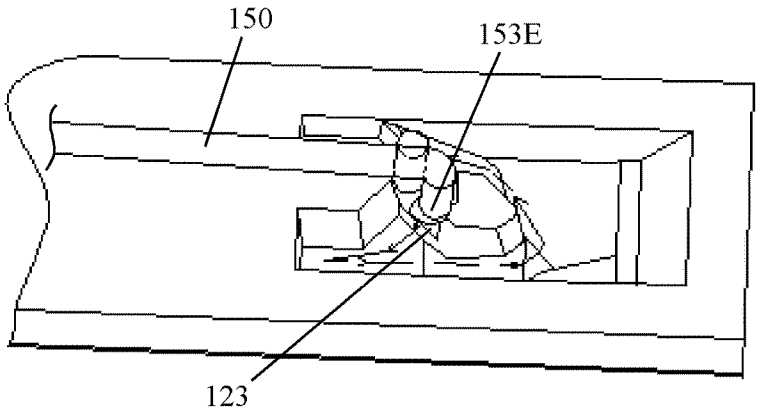
FIG. 56 is the same as the perspective view of FIG. 54.
Figure 55:
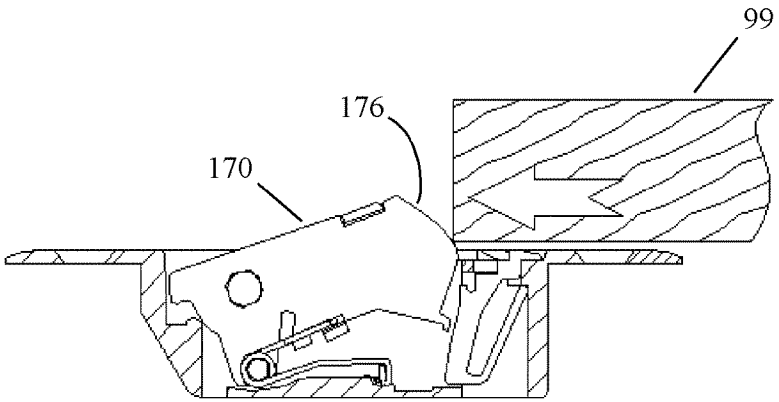
FIG. 55 is the cross-sectional view of FIG. 53, but is shown after the sash member is moved back into contact with the tumbler, but now contacts a deflection surface of the tumbler, as it is positioned in the partially extended tumbler position.

FIG. 55 is the cross-sectional view of FIG. 53, but shows the sash member 99 after being moved sufficiently to just contact the deflection surface 176 of the tumbler 170, while it still occupies the partially extended tumbler position. Since the tumbler was not moved, the curved end 153E of the second arm 153 of the biasing member 150 in FIG. 56 is still positioned at the third contact position 123, as shown in the FIG. 54.

Figure 58:
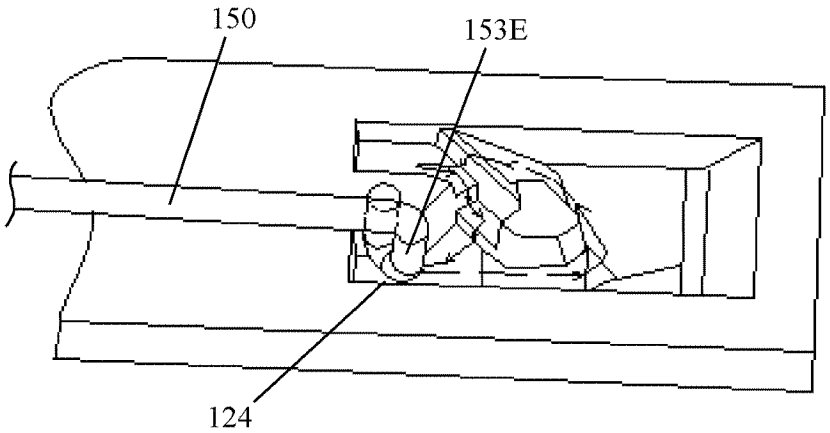
FIG. 58 is the perspective view of FIG. 56, but showing the end of the biasing member having moved away from the third contact point into a fourth contact point, after moving along a second guide wall of the contoured housing feature, due to the changed position of the tumbler shown in FIG. 57.
Figure 57:
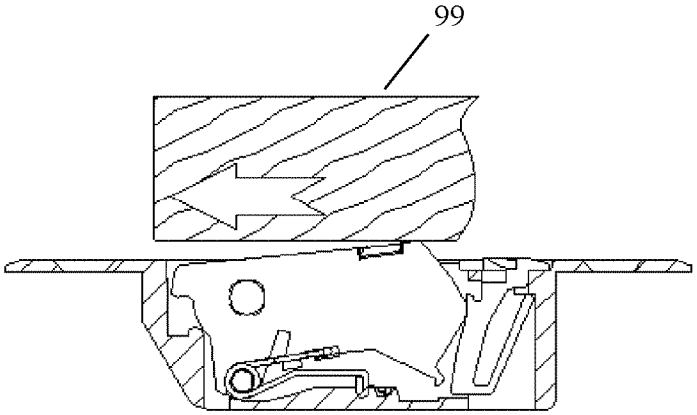
FIG. 57 is the cross-sectional view of FIG. 55, but is shown after continued contact of the sash member with the deflection surface of the tumbler has caused the tumbler to pivot and retract into an intermediate tumbler position, and the sash member is free to move beyond the limited open window position.

FIG. 57 is the cross-sectional view of FIG. 55, but is shown after continued contact of the sash member 99 with the deflection surface 176 of the tumbler 170 has caused the tumbler to pivot and retract into an intermediate tumbler position, and the sash member is free to move beyond the limited open window position. FIG. 58 is the perspective view of FIG. 56, showing the curved end 153E of the second arm 153 of the biasing member 150 after having followed a second guide wall to move away from the third contact point 123 into a fourth contact point 124, due to the changed position of the tumbler shown in FIG. 57.

Figure 60:
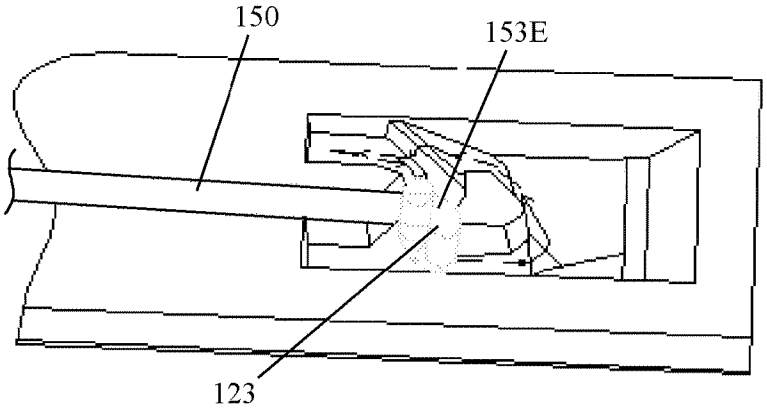
FIG. 60 is the perspective view of FIG. 58, but showing the end of the biasing member having moved away from the fourth contact point part way towards the first contact point of the contoured housing feature, due to the changed position of the tumbler shown in FIG. 59.
Figure 59:
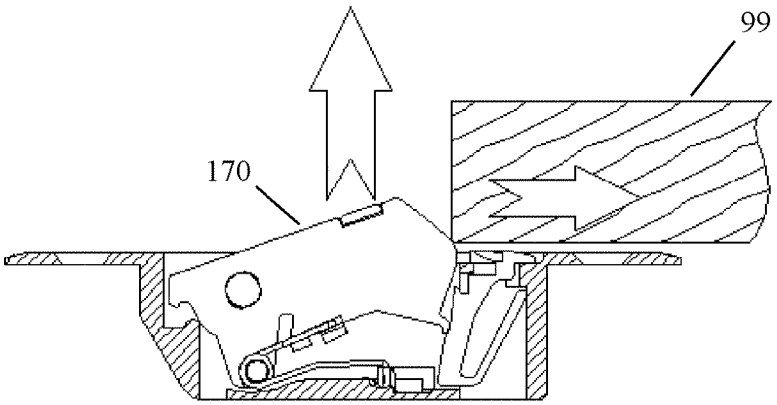
FIG. 59 is the cross-sectional view of FIG. 57, but is shown after the sash member has been moved back towards the closed window position far enough to permit the biasing member to begin biasing the tumbler from the intermediate tumbler position towards the first (extended) tumbler position.

FIG. 59 is the cross-sectional view of FIG. 57, but is shown after the sash member 99 has been moved back towards the closed window position far enough to permit the biasing member 150 to begin biasing the tumbler 170 from the intermediate tumbler position part way towards the extended tumbler position. FIG. 60 is the perspective view of FIG. 58, showing the curved end 153E of the second arm 153 of the biasing member 150 having moved away from the fourth contact point 124 part way to the first contact point 121 of the contoured housing feature 120, due to the changed position of the tumbler shown in FIG. 59. The tumbler is prevented from returning to the recess at the third contact point 123 by the contouring, which may include a slope, or another guide wall.

Figure 62:
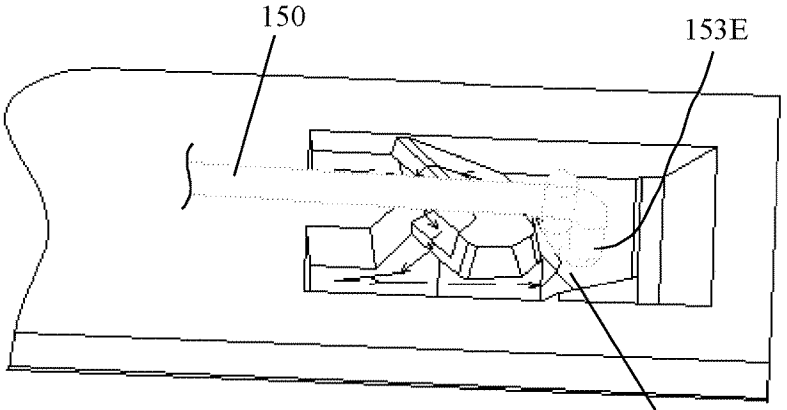
FIG. 62 is the perspective view of FIG. 60, but showing the end of the biasing member having moved back into the first contact point on the contoured housing feature, due to the changed position of the tumbler shown in FIG. 61.
Figure 61:
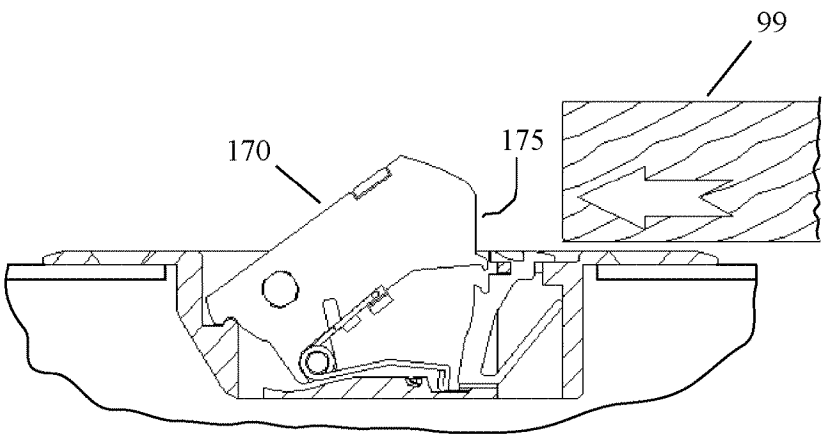
FIG. 61 is the cross-sectional view of FIG. 59, but is shown after the sash member has been moved back sufficiently towards the closed window position to be clear of the tumbler of the vent stop, with the biasing member having biased the tumbler back into the extended tumbler position, and with the safety button having been biased back into the first button position.

FIG. 61 is the cross-sectional view of FIG. 59, but is shown after the sash member 99 has been moved back sufficiently towards the closed window position to be clear of the tumbler 170, with the biasing member 150 having biased the tumbler back into the extended tumbler position, and with the safety button 130 having been biased back into the first button position. FIG. 62 is the perspective view of FIG. 60, showing the curved end 153E of the second arm 153 of the biasing member 150 having moved back into the first contact point 121 on the contoured housing feature 120, due to the changed position of the tumbler shown in FIG. 61.

As seen in FIG. 8, and the sequence of images in FIGS. 46, 48, 50, 52, 54, 58, 60, and 62, when the tumbler 170 is moved sequentially between the extended tumbler position, the retracted tumbler position, the partially extended tumbler position, and the intermediate tumbler position, and then back to the extended tumbler position, the curved end 153E of the second arm 153 of the biasing member 150 moves sequentially along the contoured feature in a generally circuitous and round-trip path that begins and ends at the first contour point, after reaching the second contour point, the third contour point, and the fourth contour point.

While illustrative implementations of one or more embodiments of the present invention are provided hereinabove, those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the exemplary embodiments without departing from the spirit of this invention.

Accordingly, the breadth and scope of the present disclosure should not be limited by any of the above-described example embodiments, but should be defined only in accordance with the following claims and their equivalents.

What is claimed is:

1. A vent stop, for use on a window to limit sliding of a sash member with respect to a master frame of the window between a closed position and a partially opened position, the partially opened position being between the closed position and a fully opened position, said vent stop comprising;

a housing configured to mount said vent stop to the window, said housing comprising an opening defining an interior surface of a cavity, said interior surface comprising a contoured feature;

a tumbler, said tumbler comprising a first end and a second end; said tumbler mounted to said housing to pivot between a retracted tumbler position and an extended tumbler position; said second end of said tumbler comprising a bearing surface and a deflection surface; at least a substantial portion of said bearing surface in said retracted tumbler position being positioned within said housing cavity, said bearing surface in said extended tumbler position being positioned to restrict opening of the sash member to the partially opened position; said deflection surface in said extended tumbler position positioned outside of said housing cavity;

a biasing member, said biasing member configured to bias said second end of said tumbler to pivot outward from said housing cavity toward said extended tumbler position; a portion of said biasing member positioned to contact and move along said contoured feature to selectively limit said pivot of said tumbler from said retracted tumbler position to a partially extended tumbler position;

a safety button mounted to said housing to slide between a first button position and a second button position;

wherein said safety button in said first button position blocks said pivot of said tumbler from said extended tumbler position into said retracted tumbler position;

wherein when said safety button is actuated into said second button position, actuation proximate to said second end of said tumbler counters said bias and causes said tumbler to pivot from said extended tumbler position to said retracted tumbler position, to cause said portion of said biasing member to move along said contoured feature from a first contour position to a second contour position;

wherein when the actuation proximate to said second end of said tumbler ceases, said biasing member biases said tumbler to pivot outward from said retracted tumbler position, to cause said portion of said biasing member to move along said contoured feature from said second contour position to a third contour position that limits said bias of said tumbler to said partially extended tumbler position; and wherein the sash member sliding toward the fully opened position contacts said deflection surface in said extended tumbler position and causes said tumbler to pivot into an intermediate tumbler position, being between said partially extended tumbler position and said retracted tumbler position, to permit the sash member to slide beyond the partially opened position, and causes said biasing member to move along said contoured feature from said third contour position to a fourth contour position that no longer limits said bias of said tumbler to said partially extended tumbler position;

wherein when the sash member moves at least back to a position between the partially opened position and the closed position, said tumbler is biased by said biasing member into said extended tumbler position, to cause said portion of said biasing member to move along said contoured feature from said fourth contour position back to said first contour position;

wherein when said tumbler is moved sequentially between said extended tumbler position, said retracted tumbler position, said partially extended tumbler position, and said intermediate tumbler position, said portion of said biasing member moves sequentially along said contoured feature in a generally circuitous path between said first contour position, said second contour position, said third contour position, said fourth contour position, and said first contour position;

wherein said housing comprises: a top plate; one or more side walls, said one or more side walls joined to and extending from a bottom surface of said top plate; and a bottom wall connected to said one or more side walls; at least a portion of said top plate overhangs beyond at least a portion of said one or more side walls to create a lip; and wherein an exposed surface of said safety button is substantially co-planar with a top surface of said top plate.

2. The vent stop according to claim 1, wherein said safety button is positioned in said housing adjacent to said second end of said tumbler, and is configured to be covered by the sash member when the sash member is in the partially opened position and in contact with said bearing surface.

3. The vent stop according to claim 2, wherein when said safety button is in said first button position, a portion of said tumbler engages a portion of said safety button to block said pivot of said tumbler into said retracted tumbler position.

4. The vent stop according to claim 3, further comprising a spring positioned to bias said safety button toward said first button position;

wherein when said tumbler is in said retracted tumbler position, and said safety button is biased back toward said first button position by said spring, a curved surface of said tumbler contacts a cam surface of said safety button to block said biased sliding of said safety button back into said first button position, until said tumbler is moved back to said extended tumbler position.

5. The vent stop according to claim 4, wherein said biasing member comprises a helical torsion spring, said helical torsion spring comprising a helical coil with first and second arms extending therefrom.

6. The vent stop according to claim 5, wherein said helical coil and said first arm of said torsion spring are affixed to said tumbler, and wherein said portion of said biasing member in said contact with said contoured feature comprises an end portion of said second arm of said torsion spring.

7. A window vent stop configured to releasably restrict sliding of a sash member from a closed position to a partially opened position being between the closed position and a fully opened position, said vent stop comprising:

a housing configured to mount said vent stop to a window, and comprising an opening into a cavity, and a contoured track;

a tumbler pivotally mounted to said housing, and comprising a bearing surface and a deflection surface;

a biasing member having a first portion secured to said tumbler and a second portion in movable contact with said contoured track, being thereby configured to selectively bias said tumbler to pivot outward from said housing cavity;

a safety button, said safety button being slidably mounted to said housing to slide between a first button position and a second button position; wherein when said safety button is in said first button position, said safety button blocks pivoting of said tumbler, and in said second button position, pivoting of said tumbler not blocked by said safety button;

wherein movement of said second portion of said biasing member along said contoured track is coordinated with sequential pivoting of said tumbler from an extended position, to a retracted position, to a partially extended position, to an intermediate position, and back to said extended position; in said extended position, said bearing surface restricts opening of the sash member to the partially opened position; wherein when said tumbler is toggled from said extended position to said retracted position and is released, said outward bias is limited by contact of said second portion of said biasing member reaching and being releasably retained at a contact point of said contoured track, to limit said bias of said tumbler into said partially extended position; and wherein subsequent contact of the sash member with said deflection surface causes said tumbler to pivot from said partially extended position into said intermediate tumbler position, to permit opening of the sash member beyond the partially opened position, and release said second portion of said biasing member from said contact point on said contoured track, to cause biasing of said tumbler from said intermediate tumbler position to said extended position; and wherein said safety button is positioned in said housing adjacent to said bearing surface of said tumbler, and is thereby configured to be covered by the sash member when the sash member is in the partially opened position and further opening is restricted by said bearing surface.

8. The vent stop according to claim 7, further comprising means for biasing said safety button towards said first button position.

9. A window vent stop configured to releasably restrict sliding of a sash member from a closed position to only a partially opened position being between the closed position and a fully opened position, said vent stop comprising:

a housing, said housing configured to mount said vent stop to a window; said housing comprising an opening defining an interior surface of a housing cavity;

a tumbler, said tumbler comprising a first end and a second end; said tumbler mounted to said housing to pivot between a retracted tumbler position and an extended tumbler position; said second end of said tumbler comprising a bearing surface; at least a substantial portion of said bearing surface in said retracted tumbler position being positioned within said housing cavity; and at least a substantial portion of said bearing surface in said extended tumbler position being positioned outside of said housing to restrict opening of the sash member to the partially opened position;

a biasing member, said biasing member having a first portion secured to said tumbler and a second portion in movable contact with said interior surface of said housing cavity, being thereby configured to bias said tumbler to pivot outward from said housing cavity toward said extended tumbler position;

a safety button, said safety button being slidably mounted to said housing to slide between a first button position and a second button position; wherein when said safety button is in said first button position, said safety button blocks pivoting of said tumbler from said extended tumbler position into said retracted tumbler position, and when said safety button is in said second button position, pivoting of said tumbler not blocked by said safety button;

means for biasing said safety button to slide toward said first button position; and wherein an exposed surface of said safety button is proximate to a top surface of said housing; and wherein said safety button is positioned in said housing adjacent to said bearing surface of said tumbler, and said top surface of said safety button is thereby configured to be covered by the sash member when the sash member is in the partially opened position and in proximity to said bearing surface, to redundantly prevent said pivot of said tumbler from said extended tumbler position into said retracted tumbler position.

10. The vent stop according to claim 9, wherein said safety button further comprises a cam surface;

wherein said tumbler comprises an apex, said bearing surface configured to transition into said apex; and wherein when said tumbler is in said extended tumbler position, and said safety button is actuated to slide into said second button position, actuation of said tumbler toward said retracted tumbler position causes said apex to contact and slide relative to said cam surface of said safety button to maintain said actuated second button position of said safety button.

11. The vent stop according to claim 10, further comprising means for opposing said bias of said biasing member for releasably retaining said tumbler in said retracted tumbler position until actuated to move into said extended tumbler position.

* * * * *